US008142236B2

(12) United States Patent
Fedder et al.

(10) Patent No.: US 8,142,236 B2
(45) Date of Patent: Mar. 27, 2012

(54) ELECTRICAL CONNECTOR HAVING IMPROVED DENSITY AND ROUTING CHARACTERISTICS AND RELATED METHODS

(75) Inventors: James L. Fedder, Etters, PA (US); Douglas W. Glover, Dauphin, PA (US); David W. Helster, Harrisburg, PA (US); Chad W. Morgan, Mechanicsburg, PA (US); Brent Rothermel, Pottstown, PA (US); Alex M. Sharf, Harrisburg, PA (US); Attalee S. Taylor, Palmyra, PA (US); David A. Trout, Lancaster, PA (US)

(73) Assignee: Tyco Electronics Corporation, Middletown, PA (US)

( * ) Notice: Subject to any disclaimer, the term of this patent is extended or adjusted under 35 U.S.C. 154(b) by 337 days.

(21) Appl. No.: 12/020,345

(22) Filed: Jan. 25, 2008

(65) Prior Publication Data

US 2008/0182460 A1 Jul. 31, 2008

Related U.S. Application Data

(63) Continuation-in-part of application No. 11/462,012, filed on Aug. 2, 2006, now Pat. No. 7,413,484.

(51) Int. Cl.
*H01R 13/42* (2006.01)

(52) U.S. Cl. ..... 439/751

(58) Field of Classification Search ..... 439/751, 439/746, 82

See application file for complete search history.

(56) References Cited

U.S. PATENT DOCUMENTS

| | | | |
|---|---|---|---|
| 3,538,486 | A | 11/1970 | Shlesinger, Jr. |
| 3,601,772 | A | 8/1971 | Mancini et al. |
| 3,651,432 | A | 3/1972 | Henschen et al. |
| 3,669,054 | A | 6/1972 | Desso et al. |
| 3,748,633 | A | 7/1973 | Lundergan |
| 3,760,336 | A | 9/1973 | Cerwin |

(Continued)

FOREIGN PATENT DOCUMENTS

DE 3511344 A1 10/1986

(Continued)

OTHER PUBLICATIONS

International Search Report and Written Opinion for International Application No. PCT/US2009/000343, dated Apr. 8, 2009, 12 pages.

(Continued)

*Primary Examiner* — Tulsidas C Patel
*Assistant Examiner* — Phuongchi Nguyen

(57) ABSTRACT

An electrical terminal of the type to be inserted into an aperture of an electrical panel member is provided. The electrical terminal may include a base, an insertion portion extending from the base to a first end, a slit formed through the insertion portion and defining a compliant portion having a first leg and a second leg. A segment of the first leg may be deformed in one direction, while a segment of the second leg may deformed in the opposite direction. Midpoints of each or both legs may be offset from the midpoint of the slit to achieve improved mechanical and electrical performance within a connector. Also provided is an electrical terminal having a tip that facilitates alignment with a panel member aperture and provides tactile feedback to a user, as well as an electrical terminal having a mounting end that is substantially smaller than its mating end, and connectors containing such terminals. Methods of routing electrical traces between adjacent electrical terminals are also provided.

17 Claims, 14 Drawing Sheets

U.S. PATENT DOCUMENTS

| | | | |
|---|---|---|---|
| 4,070,084 | A | 1/1978 | Hutchison |
| 4,157,612 | A | 6/1979 | Rainal |
| 4,186,982 | A | 2/1980 | Cobaugh et al. |
| 4,191,440 | A | 3/1980 | Schramm |
| 4,215,910 | A | 8/1980 | Walter |
| 4,260,212 | A | 4/1981 | Ritchie et al. |
| 4,288,139 | A | 9/1981 | Cobaugh et al. |
| 4,451,107 | A | 5/1984 | Dola et al. |
| 4,464,003 | A | 8/1984 | Goodman et al. |
| 4,484,792 | A | 11/1984 | Tengler et al. |
| 4,513,499 | A | 4/1985 | Roldan |
| 4,558,917 | A | 12/1985 | Kamono et al. |
| 4,571,014 | A | 2/1986 | Robin et al. |
| 4,577,922 | A | 3/1986 | Stipanuk et al. |
| 4,596,428 | A | 6/1986 | Tengler |
| 4,601,527 | A | 7/1986 | Lemke |
| 4,602,831 | A | 7/1986 | Lockard |
| 4,606,589 | A | 8/1986 | Elsbree, Jr. et al. |
| 4,611,867 | A | 9/1986 | Ichimura et al. |
| 4,621,305 | A | 11/1986 | Daum |
| 4,632,476 | A | 12/1986 | Schell |
| 4,655,515 | A | 4/1987 | Hamsher, Jr. et al. |
| 4,655,518 | A | 4/1987 | Johnson et al. |
| 4,655,537 | A | 4/1987 | Andrews, Jr. |
| 4,659,155 | A | 4/1987 | Walkup et al. |
| 4,686,607 | A | 8/1987 | Johnson |
| 4,701,138 | A | 10/1987 | Key |
| 4,705,332 | A | 11/1987 | Sadigh-Behzadi |
| 4,710,133 | A | 12/1987 | Lindeman |
| 4,711,506 | A | 12/1987 | Tanaka |
| 4,712,849 | A | 12/1987 | Seidel et al. |
| 4,734,058 | A | 3/1988 | Pavlacka |
| 4,737,114 | A | 4/1988 | Yaegashi |
| 4,763,408 | A | 8/1988 | Heisey et al. |
| 4,768,961 | A | 9/1988 | Lau |
| 4,774,763 | A | 10/1988 | Palecek et al. |
| 4,776,803 | A | 10/1988 | Pretchel et al. |
| 4,780,093 | A | 10/1988 | Walse et al. |
| 4,784,620 | A | 11/1988 | Tanaka |
| 4,804,332 | A | 2/1989 | Pirc |
| 4,806,107 | A | 2/1989 | Arnold et al. |
| 4,820,169 | A | 4/1989 | Weber et al. |
| 4,824,383 | A | 4/1989 | Lemke |
| 4,826,443 | A | 5/1989 | Lockard |
| 4,836,791 | A | 6/1989 | Grabbe et al. |
| 4,846,727 | A | 7/1989 | Glover et al. |
| 4,857,018 | A | 8/1989 | Pickles |
| 4,869,677 | A | 9/1989 | Johnson et al. |
| 4,871,321 | A | 10/1989 | Johnson |
| 4,881,904 | A | 11/1989 | Ammon et al. |
| 4,882,554 | A | 11/1989 | Akaba et al. |
| 4,889,504 | A | 12/1989 | Barbier et al. |
| 4,914,062 | A | 4/1990 | Voltz |
| 4,952,172 | A | 8/1990 | Barkus et al. |
| 4,975,069 | A | 12/1990 | Fedder et al. |
| 4,975,084 | A | 12/1990 | Fedder et al. |
| 4,976,628 | A | 12/1990 | Fedder |
| 4,980,801 | A | 12/1990 | Guinda et al. |
| 4,984,992 | A | 1/1991 | Beamenderfer et al. |
| 4,998,887 | A | 3/1991 | Kaufman et al. |
| 5,046,960 | A | 9/1991 | Fedder |
| 5,055,069 | A | 10/1991 | Townsend et al. |
| 5,066,236 | A | 11/1991 | Broeksteeg |
| 5,077,893 | A | 1/1992 | Mosquera et al. |
| 5,104,341 | A | 4/1992 | Gilissen et al. |
| 5,117,331 | A | 5/1992 | Gebara |
| 5,122,077 | A | 6/1992 | Maejima et al. |
| 5,129,831 | A | 7/1992 | Locati |
| 5,131,872 | A | 7/1992 | Consoli et al. |
| 5,139,446 | A | 8/1992 | Costello et al. |
| 5,141,453 | A | 8/1992 | Fusselman et al. |
| 5,161,996 | A | 11/1992 | Locati |
| 5,163,849 | A | 11/1992 | Fogg et al. |
| 5,171,161 | A | 12/1992 | Kachlic |
| 5,174,770 | A | 12/1992 | Sasaki et al. |
| 5,194,020 | A | 3/1993 | Voltz |
| 5,215,473 | A | 6/1993 | Brunker et al. |
| 5,224,867 | A | 7/1993 | Ohtsuki et al. |
| 5,228,864 | A | 7/1993 | Fusselman et al. |
| 5,236,375 | A | 8/1993 | Kachlic |
| 5,238,414 | A | 8/1993 | Yaegashi et al. |
| 5,259,768 | A | 11/1993 | Brunker et al. |
| 5,274,918 | A | 1/1994 | Reed |
| 5,286,212 | A | 2/1994 | Broeksteeg |
| 5,342,211 | A | 8/1994 | Broeksteeg |
| 5,354,219 | A | 10/1994 | Wanjura |
| 5,356,300 | A | 10/1994 | Costello et al. |
| 5,368,505 | A | 11/1994 | Hoolhorst et al. |
| 5,374,204 | A | 12/1994 | Foley et al. |
| 5,388,995 | A | 2/1995 | Rudy, Jr. et al. |
| 5,403,206 | A | 4/1995 | McNamara et al. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,484,310 | A | 1/1996 | McNamara et al. |
| 5,496,183 | A | 3/1996 | Soes et al. |
| 5,522,737 | A | 6/1996 | Brunker et al. |
| 5,525,066 | A | 6/1996 | Morlion et al. |
| 5,525,067 | A | 6/1996 | Gatti |
| 5,577,935 | A | 11/1996 | Harting et al. |
| 5,580,283 | A | 12/1996 | O'Sullivan et al. |
| 5,590,463 | A | 1/1997 | Feldman et al. |
| 5,609,502 | A | 3/1997 | Thumma |
| 5,645,436 | A | 7/1997 | Shimizu et al. |
| 5,664,968 | A | 9/1997 | Mickievicz |
| 5,664,970 | A | 9/1997 | Millhimes et al. |
| 5,672,064 | A | 9/1997 | Provencher et al. |
| 5,679,006 | A | 10/1997 | Madelaine |
| 5,702,258 | A | 12/1997 | Provencher et al. |
| 5,730,609 | A | 3/1998 | Harwath |
| 5,741,144 | A | 4/1998 | Elco et al. |
| 5,794,336 | A | 8/1998 | Hopson et al. |
| 5,795,191 | A | 8/1998 | Preputnick et al. |
| 5,817,973 | A | 10/1998 | Elco |
| 5,823,830 | A | 10/1998 | Wurster |
| 5,860,816 | A | 1/1999 | Provencher et al. |
| 5,882,227 | A | 3/1999 | Neidich |
| 5,893,779 | A | 4/1999 | Bianca et al. |
| 5,944,538 | A | 8/1999 | Sorig |
| 5,944,563 | A | 8/1999 | Nagafuji |
| 5,961,355 | A | 10/1999 | Morlion et al. |
| 5,980,321 | A | 11/1999 | Cohen et al. |
| 5,993,259 | A | 11/1999 | Stokoe et al. |
| 5,994,563 | A | 11/1999 | Beers et al. |
| 6,054,758 | A | 4/2000 | Lamson |
| 6,068,504 | A | 5/2000 | Gardner et al. |
| 6,068,520 | A | 5/2000 | Winings et al. |
| 6,077,128 | A | 6/2000 | Maag et al. |
| 6,083,047 | A | 7/2000 | Paagman |
| 6,109,933 | A | 8/2000 | Lenoir et al. |
| 6,123,554 | A | 9/2000 | Ortega et al. |
| 6,125,535 | A | 10/2000 | Chiou et al. |
| 6,129,592 | A | 10/2000 | Mickievicz et al. |
| 6,139,336 | A | 10/2000 | Olson |
| 6,146,157 | A | 11/2000 | Lenoir et al. |
| 6,146,202 | A | 11/2000 | Ramey et al. |
| 6,146,203 | A | 11/2000 | Elco et al. |
| 6,171,149 | B1 | 1/2001 | Van Zanten |
| 6,190,213 | B1 | 2/2001 | Reichart et al. |
| 6,212,755 | B1 | 4/2001 | Shimada et al. |
| 6,219,913 | B1 | 4/2001 | Uchiyama |
| 6,220,896 | B1 | 4/2001 | Bertoncini et al. |
| 6,231,402 | B1 | 5/2001 | Kikuchi |
| 6,267,604 | B1 | 7/2001 | Mickievicz et al. |
| 6,269,539 | B1 | 8/2001 | Takahashi et al. |
| 6,280,201 | B1 | 8/2001 | Morris |
| 6,287,132 | B1 | 9/2001 | Perino et al. |
| 6,293,827 | B1 | 9/2001 | Stokoe |
| 6,299,483 | B1 | 10/2001 | Cohen et al. |
| 6,319,075 | B1 | 11/2001 | Clark et al. |
| 6,323,116 | B1 | 11/2001 | Lamson |
| 6,328,602 | B1 | 12/2001 | Yamasaki et al. |
| 6,347,952 | B1 | 2/2002 | Hasegawa et al. |
| 6,350,134 | B1 | 2/2002 | Fogg et al. |
| 6,358,061 | B1 | 3/2002 | Regnier |
| 6,363,607 | B1 | 4/2002 | Chen et al. |

| | | | | |
|---|---|---|---|---|
| 6,364,710 | B1 | 4/2002 | Billman et al. | |
| 6,371,773 | B1 | 4/2002 | Crofoot et al. | |
| 6,379,188 | B1 | 4/2002 | Cohen et al. | |
| 6,409,543 | B1 | 6/2002 | Astbury, Jr. et al. | |
| 6,431,914 | B1 | 8/2002 | Billman | |
| 6,435,913 | B1 | 8/2002 | Billman | |
| 6,435,914 | B1 | 8/2002 | Billman | |
| 6,443,745 | B1 | 9/2002 | Ellis et al. | |
| 6,447,340 | B1 | 9/2002 | Wu | |
| 6,461,194 | B2 | 10/2002 | Katoh et al. | |
| 6,461,202 | B2 | 10/2002 | Kline | |
| 6,471,548 | B2 | 10/2002 | Bertoncini et al. | |
| 6,482,038 | B2 | 11/2002 | Olson | |
| 6,506,081 | B2 | 1/2003 | Blanchfield et al. | |
| 6,540,559 | B1 * | 4/2003 | Kemmick et al. | 439/607.05 |
| 6,547,606 | B1 | 4/2003 | Johnston et al. | |
| 6,554,647 | B1 | 4/2003 | Cohen et al. | |
| 6,572,410 | B1 | 6/2003 | Volstorf et al. | |
| 6,582,250 | B2 | 6/2003 | Taylor et al. | |
| 6,609,933 | B2 | 8/2003 | Yamasaki | |
| 6,652,318 | B1 | 11/2003 | Winings et al. | |
| 6,692,272 | B2 | 2/2004 | Lemke et al. | |
| 6,716,068 | B2 | 4/2004 | Wu | |
| 6,776,649 | B2 | 8/2004 | Pape et al. | |
| 6,808,420 | B2 | 10/2004 | Whiteman, Jr. et al. | |
| 6,848,944 | B2 | 2/2005 | Evans | |
| 6,863,543 | B2 | 3/2005 | Lang et al. | |
| 6,890,214 | B2 | 5/2005 | Brown et al. | |
| 6,905,368 | B2 | 6/2005 | Mashiyama et al. | |
| 6,913,490 | B2 | 7/2005 | Whiteman, Jr. et al. | |
| 6,935,870 | B2 | 8/2005 | Kato et al. | |
| 6,945,796 | B2 | 9/2005 | Bassler et al. | |
| 6,976,886 | B2 | 12/2005 | Winings et al. | |
| 6,981,883 | B2 | 1/2006 | Raistrick et al. | |
| 6,984,135 | B2 | 1/2006 | Kaneko | |
| 6,988,902 | B2 | 1/2006 | Winings et al. | |
| 6,994,569 | B2 | 2/2006 | Minich et al. | |
| 7,008,272 | B2 | 3/2006 | Blossfeld | |
| 7,044,807 | B2 | 5/2006 | Furuno et al. | |
| 7,114,964 | B2 | 10/2006 | Winings et al. | |
| 7,118,391 | B2 | 10/2006 | Minich et al. | |
| 7,131,870 | B2 | 11/2006 | Whiteman, Jr. et al. | |
| 7,172,461 | B2 | 2/2007 | Davis et al. | |
| 7,182,643 | B2 | 2/2007 | Winings et al. | |
| 7,207,807 | B2 | 4/2007 | Fogg | |
| 7,229,318 | B2 | 6/2007 | Winings et al. | |
| 7,309,239 | B2 | 12/2007 | Shuey et al. | |
| 7,331,800 | B2 | 2/2008 | Winings et al. | |
| 7,413,484 | B2 | 8/2008 | Fedder et al. | |
| 2002/0195271 | A1 | 12/2002 | Gailus | |
| 2003/0003799 | A1 | 1/2003 | Winings | |
| 2003/0143894 | A1 | 7/2003 | Kline et al. | |
| 2004/0005795 | A1 | 1/2004 | Wu | |
| 2005/0164555 | A1 | 7/2005 | Winings et al. | |
| 2005/0170700 | A1 | 8/2005 | Shuey et al. | |
| 2005/0196987 | A1 | 9/2005 | Shuey et al. | |
| 2005/0287850 | A1 * | 12/2005 | Minich et al. | 439/108 |
| 2006/0019517 | A1 | 1/2006 | Raistrick et al. | |
| 2006/0019538 | A1 * | 1/2006 | Davis et al. | 439/608 |
| 2006/0035535 | A1 | 2/2006 | Kawahara et al. | |
| 2006/0232301 | A1 * | 10/2006 | Morlion et al. | 326/126 |
| 2006/0234531 | A1 | 10/2006 | Winings et al. | |
| 2006/0246756 | A1 | 11/2006 | Winings et al. | |
| 2006/0246786 | A1 | 11/2006 | Noguchi | |
| 2007/0007035 | A1 | 1/2007 | Roath et al. | |
| 2007/0059952 | A1 | 3/2007 | Raistrick et al. | |
| 2007/0099464 | A1 | 5/2007 | Winings et al. | |
| 2007/0123112 | A1 | 5/2007 | Caveney et al. | |
| 2007/0296066 | A1 | 12/2007 | Shuey | |
| 2008/0182438 | A1 | 7/2008 | Fedder et al. | |
| 2008/0220666 | A1 | 9/2008 | Fedder et al. | |
| 2008/0280497 | A1 | 11/2008 | Casses et al. | |

FOREIGN PATENT DOCUMENTS

| | | | |
|---|---|---|---|
| DE | 195 46 932 | C1 | 1/1997 |
| EP | 069 655 | A1 | 1/1983 |
| EP | 107 288 | A1 | 5/1984 |
| EP | 134 094 | A1 | 3/1985 |
| EP | 212 764 | A2 | 3/1987 |
| EP | 205 461 | B1 | 9/1989 |
| EP | 422 785 | A2 | 4/1991 |
| EP | 436 943 | A1 | 7/1991 |
| EP | 486 298 | A1 | 5/1992 |
| EP | 492 944 | A2 | 7/1992 |
| EP | 520 283 | A1 | 12/1992 |
| EP | 574 805 | A2 | 12/1993 |
| EP | 865 117 | A2 | 9/1998 |
| EP | 907 225 | A2 | 4/1999 |
| EP | 924 812 | A1 | 6/1999 |
| EP | 1 049 201 | A1 | 11/2000 |
| EP | 1 069 655 | A2 | 1/2001 |
| EP | 1 139 498 | A2 | 10/2001 |
| EP | 1 220 361 | A1 | 7/2002 |
| EP | 1 239 552 | A1 | 9/2002 |
| EP | 1 241 735 | A2 | 9/2002 |
| EP | 1 261 078 | A2 | 11/2002 |
| EP | 1 311 038 | A2 | 5/2003 |
| FR | 2 660 118 | | 9/1991 |
| GB | 2 027 290 | A | 2/1980 |
| GB | 2 218 578 | A | 11/1989 |
| GB | 2 276 989 | A | 10/1994 |
| GB | 2 283 620 | A | 5/1995 |
| JP | 48044791 | | 6/1973 |
| JP | SHO 49-6543 | | 2/1974 |
| JP | SHO 61-172480 | | 10/1986 |
| JP | 61-248375 | | 11/1986 |
| JP | 62-88383 | | 4/1987 |
| JP | 3-165473 | | 7/1991 |
| JP | 4-038687 | | 3/1992 |
| JP | 4-138677 | | 5/1992 |
| JP | 4-206181 | | 7/1992 |
| JP | 4-337268 | | 11/1992 |
| JP | 5-135826 | | 6/1993 |
| JP | 5-159831 | | 6/1993 |
| JP | 6-19290 | | 3/1994 |
| JP | 6-243936 | | 9/1994 |
| JP | HEI 6-88065 | | 12/1994 |
| JP | 07 161414 | | 6/1995 |
| JP | 07 211404 | | 8/1995 |
| JP | 61-243668 | | 10/1996 |
| JP | 08 315916 | | 11/1996 |
| JP | 09 017526 | | 1/1997 |
| JP | 09 237654 | | 9/1997 |
| JP | 09 330770 | | 12/1997 |
| JP | 10 055860 | | 2/1998 |
| JP | 10 334999 | | 12/1998 |
| JP | 11 185886 | | 7/1999 |
| JP | 2001-043933 | | 2/2001 |
| JP | 2002-246121 | | 8/2002 |
| JP | 2002-334748 | | 11/2002 |
| JP | 2003-217747 | | 7/2003 |
| WO | WO 87 07444 | | 12/1987 |
| WO | WO 88 05218 | | 7/1988 |
| WO | WO 92 08261 | | 5/1992 |
| WO | WO 92 22943 | | 12/1992 |
| WO | WO 96 38889 | | 12/1996 |
| WO | WO 97 02627 | | 1/1997 |
| WO | WO 97 36349 | | 10/1997 |
| WO | WO 98 00891 | | 1/1998 |
| WO | WO 98 08276 | | 2/1998 |
| WO | WO 98 11633 | | 3/1998 |
| WO | WO 98 35409 | | 8/1998 |
| WO | WO 99 19943 | | 4/1999 |
| WO | WO 99 35714 | | 7/1999 |
| WO | WO 99 36998 | | 7/1999 |
| WO | WO 02 101883 | A2 | 12/2002 |
| WO | WO 03/043138 | | 5/2003 |

OTHER PUBLICATIONS

International Search Report and Written Opinion for International Application No. PCT/US2009/000364, dated Apr. 8, 2009, 12 pages.

International Search Report and Written Opinion for International Application No. PCT/US2009/000367, dated Apr. 8, 2009, 13 pages.

International Search Report and Written Opinion for International Application No. PCT/US2009/000368, dated Apr. 8, 2009, 12 pages.

Straus, J., "Shielded In-Line Electrical Multiconnector," IBM Technical Disclosure Bulletin, vol. 10 No. 3, pp. 203-204, Aug. 1967.

Southard, "High Speed Signal Pathways From Board to Board," *Electronic Engineering*, Sep. 1981, 8 pages.
Van Wert, E., Systems Packaging Approach, 1985, 6 pages.
Inagaki et al., "High Density Multi-Pin Connector for High Speed Pulse Propagation," 1987 Proceedings, 37th Electronic Components Conference, May 1987, 6 pages.
Rhoades et al., "Signal Transmission Considerations for a Connector in Digital Input/Output Applications," 7 pages.
Fevrier, "L'Insertion a force dans les circuits imprimes", 2198 Toute L' Electronique—No. 551, Paris, 1990, pp. 34-37.
Goel, R.P. et al., "AMP Z-Pack Interconnect System," AMP Incorporated, 1990, 9 pages.
AMP, Z-Pack, Stripline 100 Connector (100 Centerline, Four-Row Right Angle, Through-Hole Mount), Electrical Performance Report, 1990 and 1991, 32 pages.
AMP, "2 mm Z-Pack HM Interconnection System," 1991, 4 pages.
AMP, 2mm Z-Pack 110 Pos. Female Daughter Card Conn. With Reduced Crosstalk Shielding, Drawing No. C-100623, Dec. 1991, 1 page.
AMP, 2mm Z-Pack 125 Pos. Female Daughter Card Conn., Drawing No. C-100524, Dec. 1991, 1 page.
AMP, Single Crosstalk Shield, Drawing No. 100_622, Jan. 22, 1992, 1 page.
AMP, Z-Pack Assy.,Drawing No. Z-Pack-127, Feb. 5, 1992, 1 page.
AMP, Point to Point Cable Assemblies, Catalog 82671, Revised May 1992, 6 pages.
AMP Incorporated, AMP Z-Pack 2mm HM Interconnection System, 1992 and 1994, 6 pages.
Teradyne, Inc., HDM/HDM Plus 2mm Backplane Interconnection System, 1993, 22 pages.
AMP, Z-Pack 2mm HM Enhanced (5+2) Connector (2 mm Centerline, Five-Row, Right Angle, Shielded Applications), Electrical Performance Report 65722, Issued Sep. 1993, 31 pages.
AMP Interconnection Systems System Packaging Technology, Z-Pack 2mm HM Connector (2mm Centerline, Five-Row, Right-Angle Applications), Electrical Performance Report 65721, Issued Jan. 1994, 32 pages.
AMP, High Speed Standard Edge Connectors, Catalog 65822, Revised Dec. 1994, 4 pages.
AMP Incorporated, AMP Z-Pack 2mm HM Interconnection System, Catalog 65911, Issued Feb. 1995, 92 pages.
Teradyne, Inc. Connection Systems Division, Electrical Characterization Report: HDM and HDM Plus Connectors, Nov. 9, 1995, 16 pages.
Amphenol TCS, Daughtercard Module Assembly HDM Connector, Drawing No. C-483-5124-00, Feb. 26, 1996, 2 pages.
Fusi, M.A. et al., "Differential Signal Transmission through Backplanes and Connectors," *Electronic Packaging and Production*, Mar. 1996, 4 pages.
Electronic Packaging & Production, A Cahners Publication, "Ensuring Signal Integrity in Connectors, Cables and Backplanes," Oct. 1996, pp. 61-69.
Teradyne: VHDM Home Page Backplane Assemblies and Connectors, www.teradyne.com/prods/bps/vhdm/vhdmfaq.html, 1997, last printed Feb. 12, 1999, 5 pages.
Teradyne: VHDM Operating Characteristics, Backplane Assemblies and Connectors, www.teradyne.com/prods/bps/vhdm/oper.html, 1997, last printed Feb. 12, 1999, 4 pages.
Teradyne: Module Illustration Page, Backplane Assemblies and Connectors www.teradyne.com/prods/bps/vhdm/mode.html, 1997, last printed Feb. 12, 1999, 4 pages.
Teradyne: VHDM—Signal Integrity, VHDM Signal Integrity, www.teradyne.com/prods/bps/vhdm/si.html, 1997, last printed Feb. 12, 1999, 4 pages.
Teradyne: VHDM—Signal Integrity, VHDM SPICE Model Summary www.teradyne.com/prods/bps/vhdm/spice.html, 1997, last printed Feb. 12, 1999, 3 pages.
Teradyne, Inc., "The VHDM Connector from Teradyne," 1997, 19 pages.
Deutsch et al., "Electrical Characteristics of High-Performance Pin-in-Socket and Pad-on-Pad Connectors," IEEE Transactions on Components, Packaging, and Manufacturing Technology, Part B, vol. 20, No. 1, pp. 64-77, Feb. 1997.
AMP, High Speed, Controlled Impedance Two-Piece Connectors (MICTOR, Micro-Strip and Z-Pack Stripline 100 Interconnection Systems), Catalog 65194, Revised Aug. 1997, 60 pages.
Teradyne, Inc., Electrical Characterization Report: VHDM Connector, TB-2034 rev. 01, Oct. 8, 1997, 20 pages.
Tyco Electronics, Z-Pack 2mm HM Type A 110 Pos. Right Angle Male Connector Assembly, Drawing No. 106015, Dec. 15, 1997, 3 pages.
AMP, AMP Z-Pack 2mm FB, 5 Row, Vertical Plug to Right Angle Receptacle, Electrical Performance Report 1242176, Issued Apr. 1998, 82 pages.
Tyco Electronics Drawing No. C 1393755-2, Apr. 15, 1998, 1 page.
AMP, Z-Pack 2mm HM, 12 Row, Vertical Plug to Right Angle Receptacle, Electrical Performance Report 1307086, Issued May 1998, 49 pages.
AMP, Z-Pack 2mm Hm 5 Row Shielded, Vertical Plug to Right Angle Receptacle, Electrical Performance Report 65722, Revised Jul. 1998, 59 pages.
AMP, 2mm HM 8 Row Connector Noise Analysis, Electrical Analysis Report # 98GC025-1, Jul. 17, 1998, 29 pages.
AMP, AMP Z-Pack 2 mm HM Connector: 2mm Centerline, Eight-row, Right Angle Applications, Electrical Performance Report 889065, Issued Sep. 1998, 59 pages.
Teradyne Connection Systems, TB-2013 HDM/HD+ Electrical Characterization Report Revision "A," Dec. 18, 1998, 19 pages.
Cannon, ITT Industries, "CHM 2.0 Connector System, acc. to IEC 61076-4-101," 1999, 36 pages.
Teradyne, Inc. VHDM High Speed Differential, 1999, 14 pages.
AMP, Connector Noise Analysis on 2mm Hard Metric, 5+2 Row HS3 6 row for Shanghai Bell "Wisdom 2000" Backplane, Electrical Analysis Report, Mar. 1, 1999, 11 pages.
FCI, Drawing No. 10016527, Aug. 25, 2005, 5 pages.
FCI, Drawing No. 201843.828.00, May 10, 1999, 2 pages.
Teradyne, "High-density connector achieves 2.5 Gbits/s," Electronic Products, May 1999, 1 page.
Fujitsu Takamisawa America, "Connector achieves high data rates," Electronic Products, Jun. 1999, 1 page.
AMP, AMP Z-Pack 2mm HM Hard Metric Connector System Catalog 65911, Revised Jun. 1999, 38 pages.
FCI, "Metral Speed and Density Extensions," Jun. 3, 1999, 25 pages.
Ortega et al., "Shielded Differential Connector Delivers Increased Bandwidth and Signal Integrity Performance," 49th Electronic Components and Technology Conference, Jul. 1-4, 1999, 6 pages.
HPCwire Article # 16805, "Connectors Crank Up for Communications," http://www.hpcwire.com/hpc-bin/artread.pl?direction=Current&articlenumber=16805, Dec. 17, 1999, last printed Feb. 26, 2007, 6 pages.
Hearst Electronic Products, Octagon Systems. "Connectors exhibit high density, speed," Dec. 1999, 1 page.
Goldie et al., "A Baker's Dozen of High-Speed Differential Backplane Design Tips," DesignCon 2000 High-Performance Design Conference, 10 pages.
FCI Framatome Group, Metral 2mm High-Speed Connectors, 1000, 2000, 3000 Series, Electrical Performance Data for Differential Applications, 2000, 119 pages.
Teradyne, VHDM High-Speed Differential,http://www.teradyne.com/prods/bps/vhdm/hsd.html, last printed Jan. 24, 2000, 3 pages.
Amphenol TCS, "NeXLev Parallel Board Interconnect Provides 2.5Gb/s Performance & 145 Real Signals per Inch," http://www.amphenol-tcs.com/about_tcs/news /2000/01_26_00_nexlev.html, Jan. 26, 2000, 2 pages.
Molex Incorporated, MZP B/B Conn. Rec. Right Angle Ass'y Type CR with Shield, Drawing No. SD 54/50-013, May 22, 2000, 1 page.
Nadolny, J. et al., "Optimizing Connector Selection for Gigabit Signal Speeds," ECN, http://www.ecnmag.com/article/CA45245, Sep. 1, 2000, lastprinted Jun. 23, 2005, 5 pages.
AMP, Z-Pack HS3 Dual Beam Receptacles, Data Sheet 1307933, Issued Sep. 2000, 2 pages.
AMP, Z-Pack HS3 6 Row Vertical Plug to Right Angle Receptacle, Electrical Performance Report 1308505, Issued Sep. 2000, 26 pages.
Tyco Electronics, Female Housing/2 rows/SMT, Drawing No. C23334-A1040-C301-7406, Sep. 9, 2000, 1 page.

AMP, Z-Pack HS3 10 Row Vertical Plug to Right Angle Receptacle, Electrical Performance Report 1308506, Issued Sep. 2000, 20 pages.
Molex, HDM and VHDM Mixed Layout Design Guide, 2001, 4 pages.
New Products, "High-Speed Signal Connector for Differential Transmission: MICRO GIGACN FCN-260 (D) Series," Find, vol. 19 pp. 52-58, 2001.
Tyco Electronics, Densipac 1.25 mm Female w centering pins, Drawing No. V23500-D11-F210-7626, Mar. 5, 2001, 2 pages.
Tyco Electronics, Densipac 1.25 Male / 2rows, Drawing No. V23500-D1-M21-7626, Mar. 5, 2001, 6 pages.
Electronicstalk, "Hard-metric connectors match fast backplanes," Jun. 13, 2001, 1 page.
AMP, Backplane / High Speed Connectors, Catalog 1307612, Revised Jul. 2001, 109 pages.
FCI, Metral 4000 Series, "High-speed Backplane Connectors," Revison 3, Nov. 30, 2001, 21 pages.
Tyco Electronics, Champ Z-Dok Connector System, Catalog 1309281, Issued Jan. 2002, 3 pages.
Tyco Electronics, Vertical Receptacle, Drawing No. 1212140, Nov. 5, 2002, 1 page.
Tyco Electronics, Assembly, Vertical Receptacle Center, 20.3 mm MultiGig Rt2, Backplane Connector, Dreawing No. 1410 40, Jan. 8, 2003, 2 pages.
Tyco Electronics, Circuits & Design Report, HM 2mm 12 row Connector Performance, Issued Mar. 21, 2003, 4 pages.
Tyco Electronics, MultiGig RT-2 Connector Routing. Report # 22GC009-1, Mar. 26, 2003, 18 pages.
Teradyne, Daughtercard Module VHDM L-Series 6 Row, Drawing No. C-421-5005-500, Arp. 3, 2003, 2 pages.
Teradyne Connection Systems, Inc., Daughtercard Module, Drawing No. C-421-5005-500, Apr. 3, 2003, 2 pages.
Tyco Electronics, "Tyco Electronics, Z-Dok+ Connector," May 23, 2003, http://2dok.tyco.electronics.com, 15 pages.
W. L. Gore & Associates, Gore Eye Opener Airmax VS Cable Assemblies, 2005, 1 page.
FCI, AirMax VS Application Datasheet, Jan. 2005, 10 pages.
Tyco Electronics, Fixing Lead Female, Drawing No. C23334-A1040-C1-7406, Jan. 10, 2005, 1 page.
Lucent Technologies, "Lucent Technologies' Bell Labs and FCI Demonstrate 25gb/S Data Transmission over Electrical backplane Connectors," Feb. 1, 2005, http://www.lucent.com/press/0205/050201.bla.html, last printed Feb. 23, 2006, 4 pages.
FCI, FCI CDC—AirMax VS product presentation, Q2 2005, 18 pages.
Teradyne, Inc. TB-2034 VHDM and VHDM-HSD Signal Integrity Characterization Report, Revision "K," Apr. 13, 2005, 31 pages.
Tyco Electronics, Z-Pack Max Connector Routing, Report # 25GC004-1, Aug. 3, 2005, 14 pages.
FCI, AirMax VS R/A Header Assy Press-Fit, Drawing No. 10016527, printed Aug. 25, 2005, 5 pages.
Tyco Electronics, Z-Dok and Z-Dok+ Connectors, Application Specification 114-13068, Aug. 30, 2005, Revision A, 16 pages.
Tyco Electronics, Female Contacts 2 r/finished condition, Drawing No. C23334-A1040-C2-7406, Dec. 8, 2005, 2 pages.
Molex, "Overview: Backplane Products," http://www.molex.com/cgi-bin/bv/molex/super_family/, 2005-2006, last printed Feb. 8, 2006, 2 pages.
Tyco Electronics, Ultra Match, World's Highest Contact Density Board B-t-B Connector, 2006, 5 pages.
Tyco Electronics, Ultra-Match, World's Highest Contact Density Board to Board Connector System, 2006, 4 pages.
FCI, Airmax VS Specifications and Test Reports, http://portal.fciconnect.com/portal/page/portal/FcicntPublic/, 2006, 3 pages.
Amphenol TCS, VHDM Connector, http://www.teradyne.com/prods/tcs/products/connectors/backplane/vhdm/index.html, last printed Jan. 31, 2006 and Feb. 8, 2006, 3 pages.
Amphenol TCS, "HDM Stacker Signal Integrity," http://www.teradyne.com/prods/tcs/products/connectors/mezzanine/hdm_stacker/, last printed Feb. 2, 2006, 3 pages.
Amphenol TCS, HDM HDM Plus Connectors, http://www.teradyne.com/prods/tcs/products/ connectors/backpiane/hdm/index.html, last printed Feb. 2, 2006, 1 page.
Amphenol TCS, "VHDM (Very High Density Metric)," http://www.molex.com/cmc_upload/0/000/0-8/vhdm_intro_TEMP.html, last printed Feb. 4, 2006, 1 page.
Hult, B., "FCI's Problem Solving Approach Changes Market, The FCI Electronics AirMax VS," ConnectroSupplier.com, http://www.connectorsupplier.com/tech_updates_FCI-Airmax_archive.htm, last printed Feb. 7, 2006, 4 pages.
Heilind Electronics, Inc., "FCI's AirMax VS Connector System Honored at DesignCon 2005," 2005, http://www.heilind.com/products/fci/airmax-vs-design.asp, last printed Feb. 8, 2006, 1 page.
FCI Airmax VS Connector System, press fit products Application Specification GS-20-035, printed Feb. 22, 2006, 22 pages.
"B.? Bandwidth and Rise Time Budgets," Module 1-8. Fiber Optic Telecommunications (E-XVI-2a), http://cord.org/step_online/st1-8/st18exvi2a.htm, last printed Feb. 27, 2006, 3 pages.
FCI, AirMax VS R/A Header Assy Press-Fit 54 Pos. 14mm, Drawing No. 10039851m, printed Mar. 22, 2006, 5 pages.
FCI, GIG-ARRAY High Speed Mezzanine Connectors, 15-40 mm Board to Board, Set-up Application Specification GS-20-016, Jun. 5, 2006, 1 page.
FCI, AirMax VS Connector System, press-fit products, Product Specification GS-12-239, printed Jun. 16, 2006, 10 pages.
FCI, Backpanel Connectors, Metral 1000 Series, Product Description, Aug. 2006, 2 pages.
FCI, Backpanel Connectors, Metral 2000 Series, Product Description, Aug. 2006, 2 pages.
FCI, Backpanel Connectors, Metral 4000 Series, Product Description, Aug. 2006, 2 pages.
FCI, 5×6 Receptacle Signal Assembly, Drawing No. 52057C, printed Sep. 23, 2006, 3 pages.
Tyco Electronics, Female Connector, Drawing No. 1857656-C1, Oct. 30, 2006, 2 pages.
Tyco Electronics, Male Connector, Drawing No. 1857646-C1, Oct. 30, 2006, 3 pages.
Molex, 45802 HD Mezz Receptacle and 45830 HD Mezz Plug, Features and Specifications, 2007, 2 pages.
FCI, 8 Row Receptacle Signal Assembly, Drawing No. 74981, printed Feb. 22, 2007, 4 pages.
FCI, Metral 1000 & 4000 Series Receptacles—5 Row, Application Specification GS-20-017, printed Feb. 22, 2007, 15 pages.
FCI, for 5-Row and 8-Row Metral 4000 Headers, Application Specification GS-20-014, printed Feb. 22, 2007, 22 pages.
FCI, for 5-Row 1000 & 2000 Headers and Shrouds, 8-Row Std., 1000 & 2000 Headers and Shrouds, Application Specification GS-20-010, printed Feb. 22, 2007, 34 pages.
FCI, Metral Standard Series—8 Row, Metral 1000 Series—8 Row, Metral 2000 Series—8 Row, Product Specification GS-12-134, printed Feb. 22, 2007, 17 pages.
Molex, MZP 2.00 mm (.079") Pitch, Hard Metric Backplance Connectors (With CompactPCI Versions), http://www.molex.com, last printed Mar. 2, 2007, 2 pages.
Signal Integrity Group, Amphenol Backplane Systems, UHD Interconnection System, Electrical Characterization Report, 10 pages.
AMP, Z-Pack Stripline 100 Right Angle Drawings, 4 pages.
AMP, Z-Pack HS3 Backplane Connector Booklet, 101 pages.
AMP, AMPMODU Interconnection System, MODU II Pin Header, Economy Line, 5 pages.
Amphenol Backplane Systems, Tuning Fork and Blade Solutions, Catalog 12-036, 12 pages.
Amphenol TCS, "About Amphenol TCS," http://www.amphenol-tcs.com/about_tcs, 3 pages.
Berg Electronics, "PCB-Mounted Receptacle Assemblies, 2.00 mm (0.079 in) Centerlines, Right-Angle Solder-to-Board Signal Receptacle," Metral 10-6-10-7, 2 pages.
Cohen, T. et al., "Shielded High Performance Interconnect Technology Dramatically Increases Real Signal Density," 7 pages.
FCI, Airmax VS High Speed Connector System, 11 pages.
FCI, Board to Board Connectors, "GIG-ARRAY Connector System," 4 pages.
FCI, Mezzanine High-Speed High-Density Connectors, GIG-ARRAY and MEG-ARRAY Electrical Performance Data, 10 pages.

Fujitsu Takamisawa America, "High speed connector sults next-generation data needs," 1 page.
Harting, Har-bus HM, Hard metric connectors according to IEC 61076-4-101, 36 pages.
Molex, HDM Separable Interface Detail, 3 pages.
Molex, 2.00mm (0.79") Pitch HDM and HDMPLUS Module-to-Backplane Connector, 6 pages.
Molex Incorporated, MZP B/B Conn. Receptacle R/A Ass'y Type C w/o Peg, Drawing No. SD-54457-045, 1 page.
Photographs depicting pin configuration used in connector such as that depicted in Tyco Electronics Drawing No. C 1393755-2, 1 page.
Sample corresponding to concurrently submitted photographs depicting pin configuration used in connector such as that depicted in Tyco Electronics Drawing No. C 1393755-2.
International Search Report for International Application No. PCT/US2007/016904, dated Dec. 18, 2007, 3 pages.
International Search Report and Written Opinion for International Application No. PCT/US2009/000345, dated May 20, 2009, 9 pp.
David M. Pozar, "Microwave Engineering," Addison-Wesley Publishing Company, Inc., Sep. 1990, pp. 67-77.

* cited by examiner

ELECTRICAL CONNECTOR HAVING IMPROVED DENSITY AND ROUTING CHARACTERISTICS AND RELATED METHODS

RELATED APPLICATIONS

The present patent document is a continuation-in-part of application Ser. No. 11/462,012, filed Aug. 2, 2006, now U.S. Pat. No. 7,413,484 which is hereby incorporated by reference in its entirety.

FIELD OF THE INVENTION

The present invention relates to electrical terminals of the type to be inserted into apertures of an electrical panel member and electrical connectors containing such terminals.

BACKGROUND OF THE INVENTION

Due to the increasing complexity of electronic components, it is desirable to fit more components in less space on a circuit board or other substrate. Consequently, the spacing between electrical terminals within connectors has been reduced, while the number of electrical terminals housed in the connectors has increased, thereby increasing the need in the electrical arts for electrical connectors that are capable of handling higher and higher speeds and to do so with greater and greater pin densities. It is desirable for such connectors to have not only reasonably constant impedance levels, but also acceptable levels of impedance and cross-talk, as well as other acceptable electrical and mechanical characteristics.

Previous attempts to design such high speed electrical connectors have focused on the mating ends of the electrical terminals in the connector to achieve desired levels of impedance and cross-talk, pin densities, and other desired electrical and mechanical characteristics, but these attempts have largely ignored the mounting ends of the electrical terminals within the connector. For example, previous attempts to reduce the cross-talk within a connector and obtain desired impedance levels involved the use of edge coupling or edge-to-edge positioning of the mating ends of the electrical terminals within a connector, without any suggestion that modifying the mounting ends of the electrical terminals would have any desirable mechanical or electrical effects within the connector. In contrast, various embodiments of the present invention focus on the mounting ends of the electrical terminals within a connector, which, surprisingly, can be configured to achieve the desired electrical performance of a high speed, high density electrical connector, while maintaining the physical characteristics necessary to readily insert the connector into a panel member aperture without damage to the terminals of the connector or the panel member apertures.

SUMMARY OF THE INVENTION

In some embodiments of the present invention, the electrical terminals have a mounting end that is substantially smaller than the mating end, resulting in mechanical and electrical advantages. Moreover, unlike known electrical terminals, various embodiments of the terminals of the present invention also are configured to provide the mechanical and electrical characteristics necessary to function within an aperture of substantially reduced size, or a micro via. For example, the configuration of the mounting portion of certain embodiments of the present invention results in improved electrical performance and impedance levels, reduced capacitance/impedance discontinuities, reduced electrical degradation, reduced capacitive coupling, and/or reduced insertion forces in micro via applications, while maintaining the structural integrity necessary for high density electrical terminals and connectors.

The electrical terminal of the present invention may include a base, an insertion portion, or mounting end, that extends from the base to a first end, and a slit formed through the insertion portion and extending from or between the base and the first end, where the slit separates a first leg and a second leg that comprise a compliant portion. In some embodiments, the insertion portion of the electrical terminal may be configured for insertion into a panel member aperture having a diameter of less than about 0.014 inch (0.36 millimeter) or less than about 0.016 inch (0.41 millimeter). A segment of the first leg may be deformed in one direction away from the slit, and a segment of the second leg may be deformed in a second direction away from the slit opposite the first leg. In certain embodiments, the center of one or more of the leg segments is offset from the center of the slit. In some embodiments, the insertion portion has a first tapered segment adjacent the first end and a second tapered segment extending from or between the first tapered segment and the base. A secondary taper from the base to the end of the leg segments may also be included.

In certain embodiments of the present invention, the electrical terminals of the connector are configured so that the insertion force associated with mounting the connector in a panel member is reduced, as compared with prior art connectors, and the insertion force is substantially constant over the length of travel of the mounting hardware in a panel member aperture. The electrical terminals of the present invention may have an end portion that facilitates insertion into and alignment with a panel member aperture by providing tactile feedback to a user.

Electrical connections with a panel member and electrical performance of the electrical connections between panel members and associated components may be improved by certain embodiments of the present invention. Some embodiments of the present invention also have the advantage that the mounting ends of the electrical terminals are configured to permit an increased number of electrical terminals per unit area (pin density) and to increase the possibilities for routing electrical traces between terminals.

In some embodiments of the present invention, a connector is provided for insertion into a panel member having apertures with a first diameter and apertures with a second diameter, where the first diameter is different from the second diameter. The dimensions of the electrical terminals to be inserted into the apertures may also vary from one terminal to the next within the connector. For example, a connector may include a first array of electrical terminals containing differential signal pairs separated by one or more grounds and a second array of electrical terminals containing differential signal pairs separated by one or more grounds, where the electrical terminals of the differential signal pairs have a first size and the ground terminals have a second size that is greater than the first size. The cross-talk between the differential signal pairs in adjacent linear arrays may be reduced by offsetting the differential signal pairs in one linear array from those of the adjacent linear array(s).

Other features and advantages of the present invention will be apparent from the following detailed description of exemplary embodiments, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION

Various embodiments of the present invention include electrical terminals and electrical connectors having desirable electrical and mechanical characteristics, such as desirable impedance levels, impedance profiles, insertion losses, cross-talk levels, pin densities, and/or insertion force profiles, for example. In some embodiments, such desirable characteristics are achieved by an electrical terminal having a mounting end that is substantially smaller than its mating end. In other embodiments, an electrical connector, such as a press-fit connector, has a plurality of electrical terminals with mounting ends that are configured to provide improved characteristics. These and other embodiments are described in more detail below.

Figure 1:
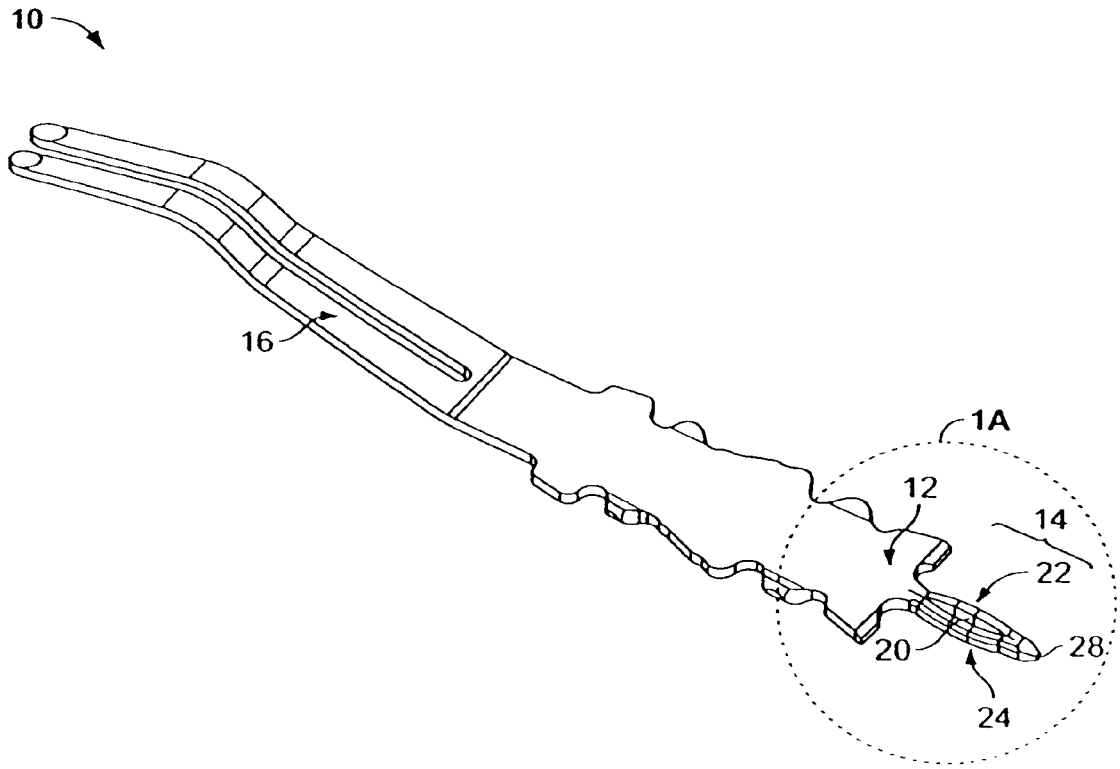
FIG. 1 is a perspective view of one embodiment of an electrical terminal of the present invention.
Figure 2:
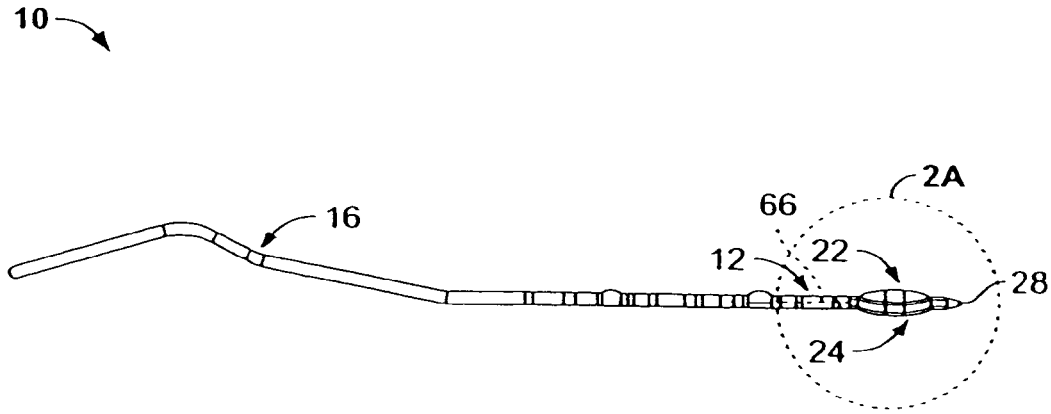
FIG. 2 is a side elevational view of the electrical terminal of FIG. 1.
Figure 3:
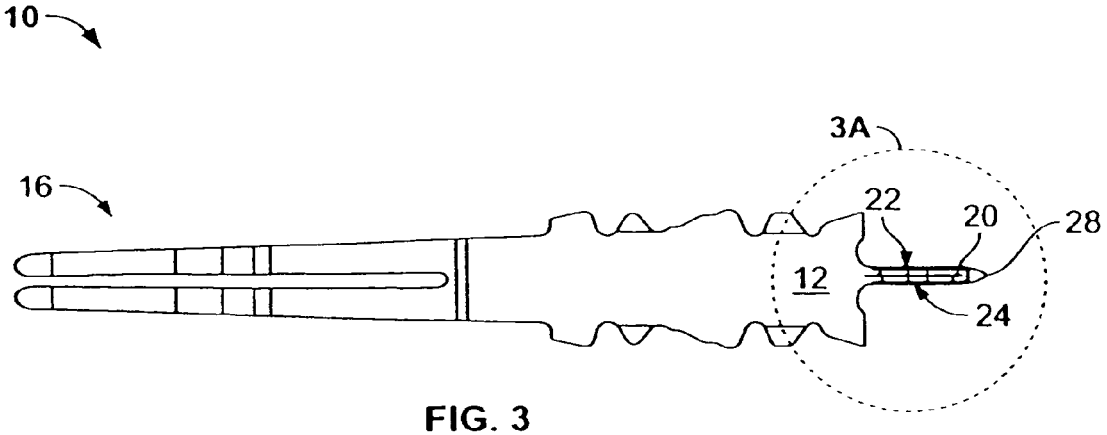
FIG. 3 is a top view of the electrical terminal of FIG. 1.

One embodiment of the present invention is directed to an electrical terminal 10, also referred to as a contact or pin, as depicted in FIGS. 1 to 3. In this embodiment, the electrical terminal 10 includes a base 12 with an insertion portion 14, or mounting end, that extends from the base 12 to an end 28. The electrical terminal 10 is configured for insertion into an aperture in a panel member or circuit board (not shown), also referred to as a substrate.

Figure 1A:
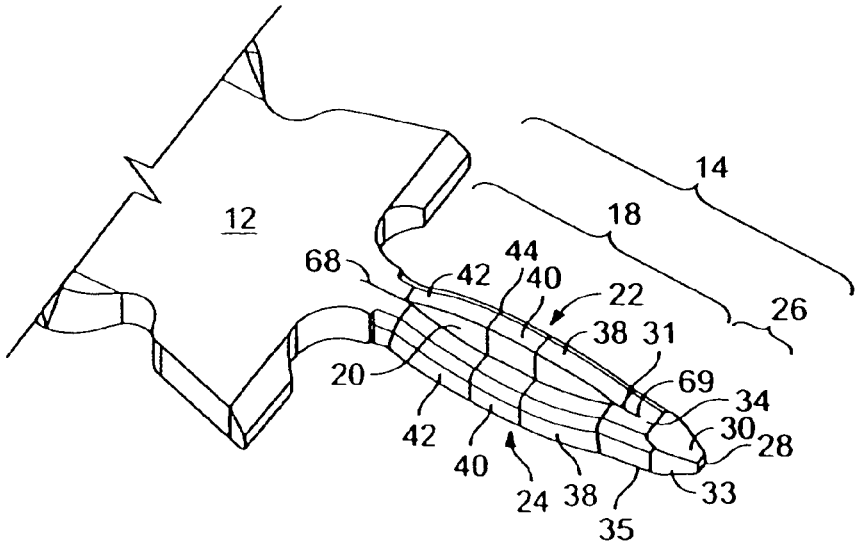
FIG. 1A is an enlarged perspective view of the portion of FIG. 1 within enclosure A.

The insertion portion 14 of the electrical terminal 10 shown in FIGS. 1 and 1A includes a compliant portion 18 and a tip or end portion 26, which has an upper surface 34 and a lower surface 35. The compliant portion 18 includes a slit 20, also referred to as a shear or elongated opening, formed in insertion portion 14, where the slit 20 is defined by two flexible leg members 22, 24, the base 12, and the end portion 26. The end portion 26 is disposed between the compliant portion 18 and the end 28 and includes a plurality of tapers 30, 32 formed adjacent to the end 28. The leg members 22, 24 of the compliant portion 18 may have a constant thickness or a variable thickness.

Figure 4:
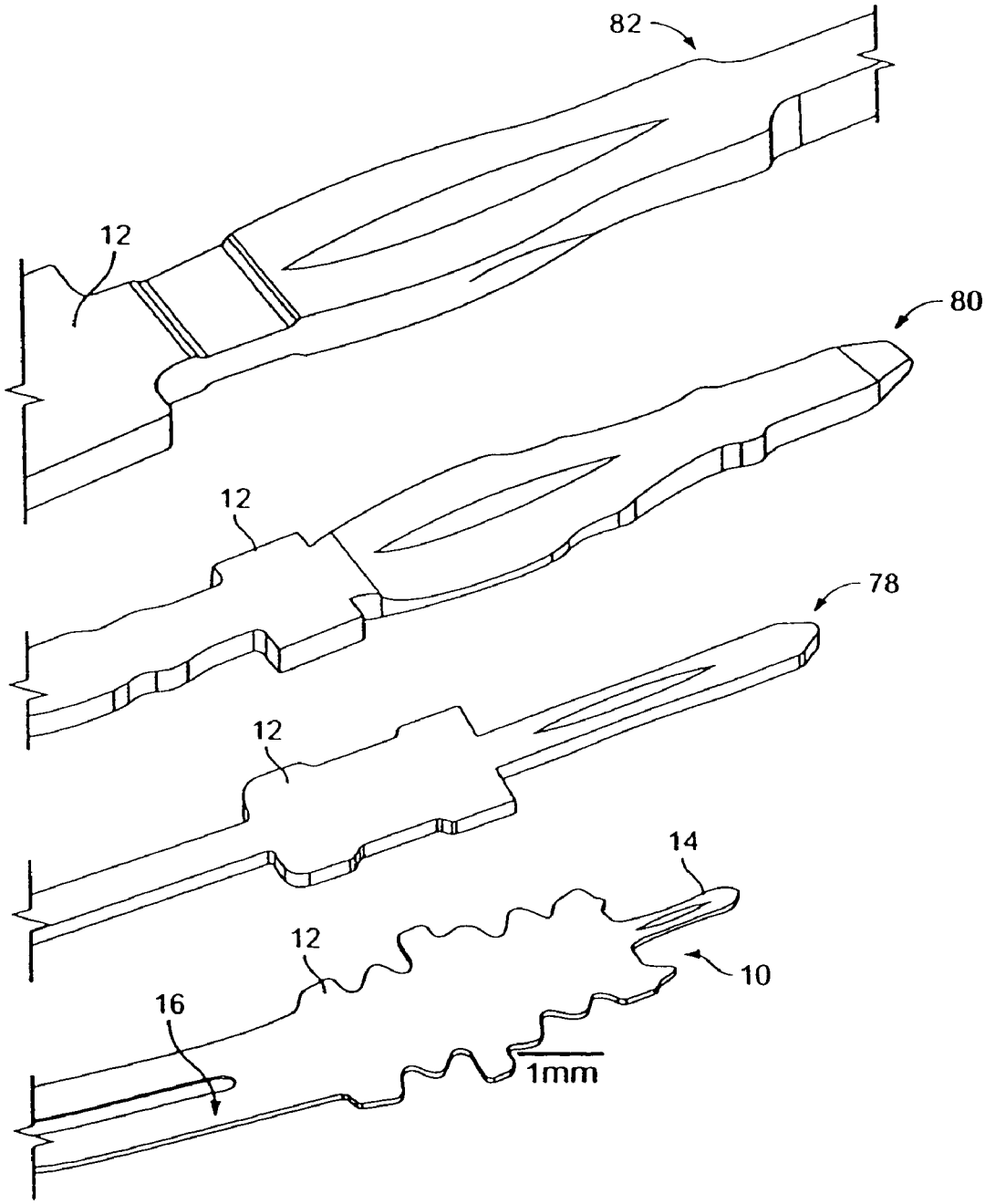
FIG. 4 is a perspective view showing the dimensions of one embodiment of the electrical terminal of the present invention, as compared with three existing electrical terminals.

In the embodiment of FIGS. 1 to 3, the base 12 is connected to a first end of each of the leg members, and the end portion 26 is connected to a second end of each of the leg members. The base 12 may be any suitable shape. Four exemplary types of bases 12 are shown in FIG. 4.

Figure 5:
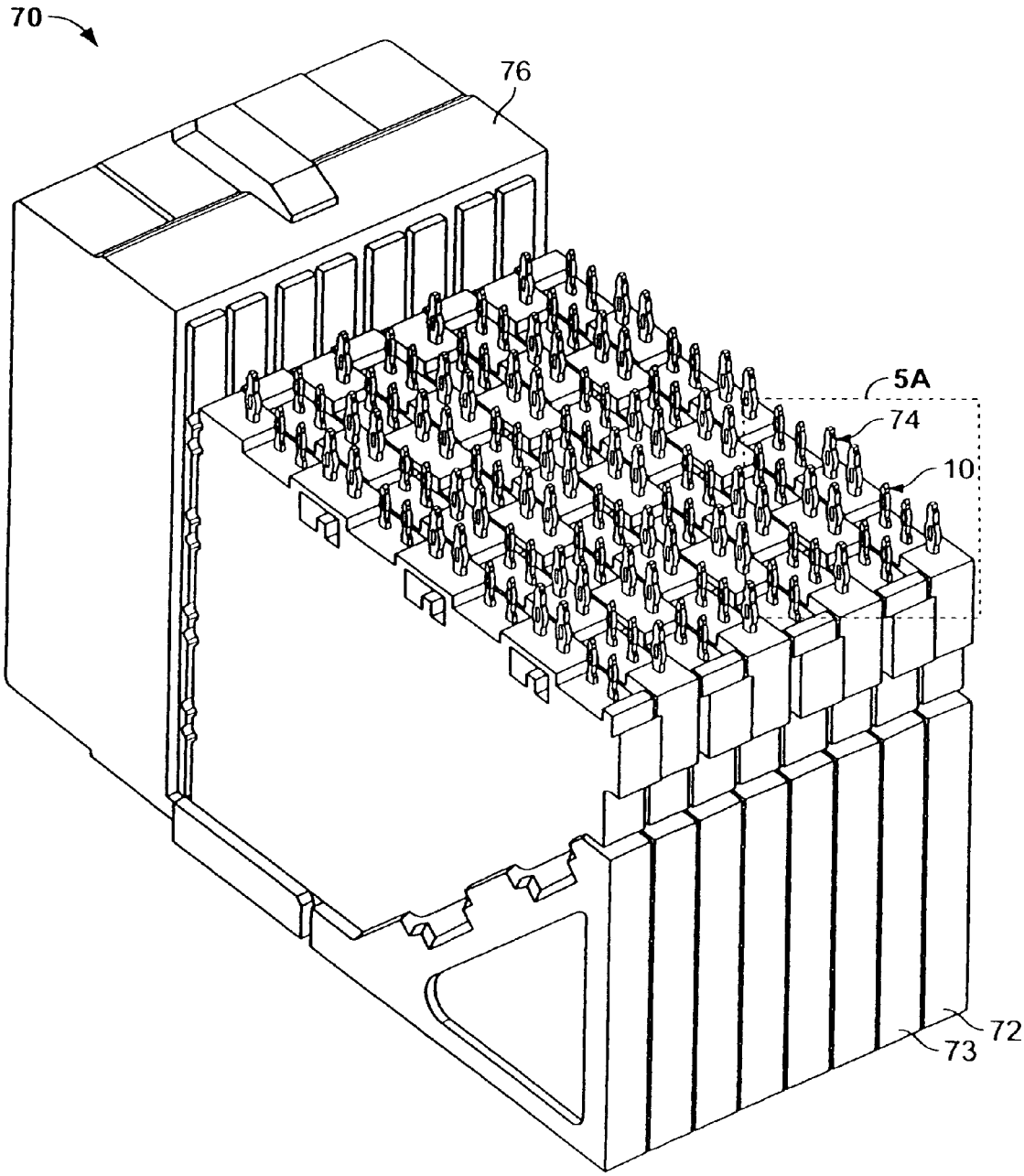
FIG. 5 is a perspective view of one embodiment of a connector of the present invention.
Figure 5A:
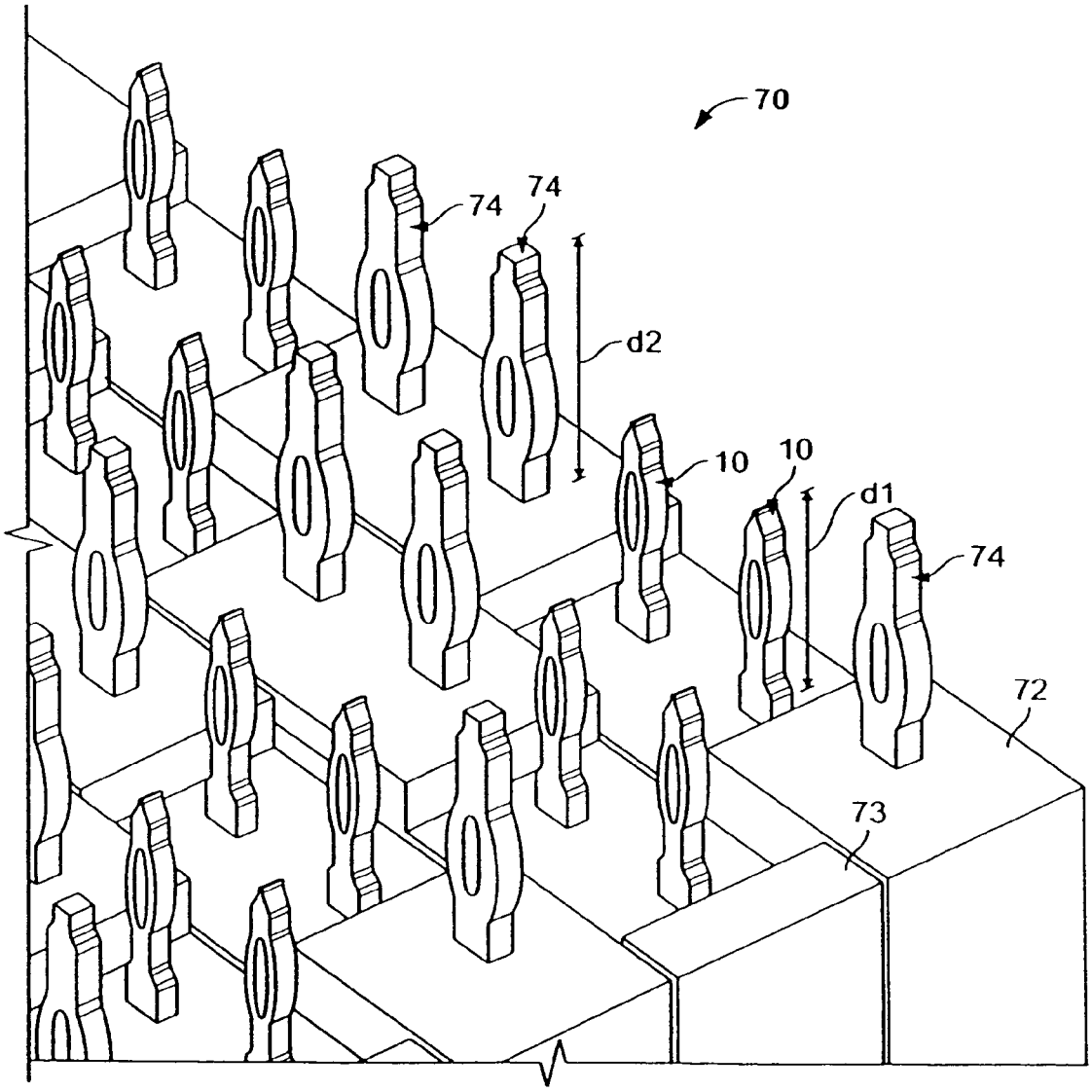
FIG. 5A is an enlarged perspective view of the portion of FIG. 5 within enclosure A.

In the embodiment of FIGS. 1 to 3, a beam portion 16, or mating end, is configured to extend into a connector 70, such as the connector shown in FIGS. 5 and 5A, and to extend from the base 12 in a direction opposite the direction in which the insertion portion 14 extends from the base 12. The embodiment of FIG. 5, which is shown in more detail in FIG. 5A, is a connector containing a plurality of lead frames 72, 73 in which the individual terminals 10 are housed. The connector may contain shields or it may be shieldless.

Figure 2A:
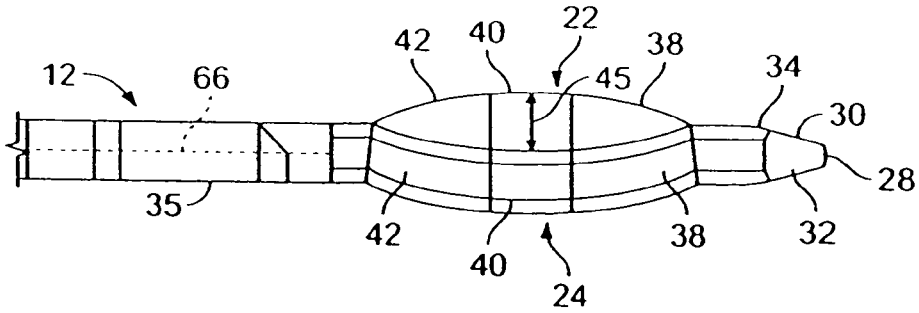
FIG. 2A is an enlarged perspective view of the portion of FIG. 2 within enclosure A.

The embodiment shown in FIGS. 1A and 2A includes a lead-in ramp 38 that is adjacent to the end of the leg 22 which is adjacent to the end 28. This ramped portion 38 extends to an intermediate segment 40 which further extends to a lead-out ramp 42. Proceeding from the end of the lead-in ramp 38 that is adjacent to the end 28, toward the base 12, the perpendicular distance between the lead-in ramp 38 and a central plane 44 increases, where the plane 44 is a substantially central plane 44 that extends from an end 68 to an end 69 of the slit 20, as shown in FIG. 1A. Continuing along the intermediate segment 40 from the end of the segment 40 that is adjacent to the lead-in ramp 38, toward the base 12, the distance between the intermediate segment 40 and the central plane 44 continues to increase for at least a portion of the length of the intermediate segment 40, reaching a maximum distance 45, and then decreasing for the remaining portion of the length of the segment 40. Further proceeding along the lead-out ramp 42 from an end of the intermediate segment 40 that is adjacent to the base 12, toward the base 12, the distance between the lead-out ramp 42 and the central plane 44 continues to decrease.

The description of one leg 22 may also apply to the other leg 24 of the compliant portion 18. In one embodiment, in which the upper and lower surfaces 34, are parallel, the second leg 24 is a mirror image of the first leg 22 with respect to a mid-plane 66 that bisects the thickness of the terminal between the upper and lower surfaces 34, 35, as shown in FIGS. 2 and 2A.

While the legs 22, 24 may have a profile defined by a plurality of linear segments (such as a trapezoidal profile) formed away from the upper surface 34 and defined by the lead-in ramps 38, intermediate segments 40, and lead-out ramps 42, the profile is not intended to be so limited. For example, any combination of the lead-in ramp 38, intermediate segment 40, and lead-out ramp 42 could define a curved or substantially arcuate profile.

In some embodiments, the legs 22, 24 are substantially symmetric with each other. In other words, in embodiments having parallel upper and lower surfaces 34, 35, the legs 22, 24 are of substantially equal size and have lead-in ramps 38, intermediate segments 40, and lead-out ramps 42 defining substantially similar profiles, albeit in opposite directions with respect to the mid-plane 66. In certain embodiments, each of the legs 22, 24 has a substantially rectangular cross sectional profile, but other profiles also may be used, including any combination and magnitude of curved or rounded edges.

The electrical terminals 10 of the present invention may be made of any suitable material. Suitable materials include, but are not limited to, metals and/or alloys or other materials having sufficient electrical conductance, formability and ability to hold a formed profile. In one embodiment, the terminals are formed from a sheet material having a thickness of about 0.006 inch (0.15 millimeter) to about 0.008 inch (0.2 millimeter), or of about 0.006 inch (0.15 millimeter) or less, and having an upper surface 34 and a lower surface 35. The electrical terminals 10 may be cut out, e.g., by stamping, or otherwise removed from the sheet of material, but, for purposes of discussion, the electrical terminal retains its upper and lower surfaces 34, 35. In one embodiment, the slit 20 is formed substantially perpendicular to the upper surface 34 and bisects the legs 22, 24, which may have substantially equal cross sectional areas. The formation of the slit 20 may, but does not necessarily, entail the removal of material from the compliant portion 18, depending upon the manufacturing techniques employed. Although the slit 20 may be primarily formed through the insertion portion 14, the slit 20 may extend from or between the base 12 and the end portion 26 of insertion portion 14. In other words, the slit 20 may extend into a portion of the base 12.

Upon formation of the slit 20, and possibly simultaneously with the formation of the slit 20, respective segments or portions of the legs 22, 24 may be deformed in substantially opposite directions. In their undeformed state, the legs 22, 24 define a plane, and upon deforming the legs, at least portions of the legs extend outside the plane, providing the interference between the legs and a corresponding aperture formed in a panel member when the insertion portion 14 of the terminal 10 is inserted into the panel member aperture.

Figure 3A:
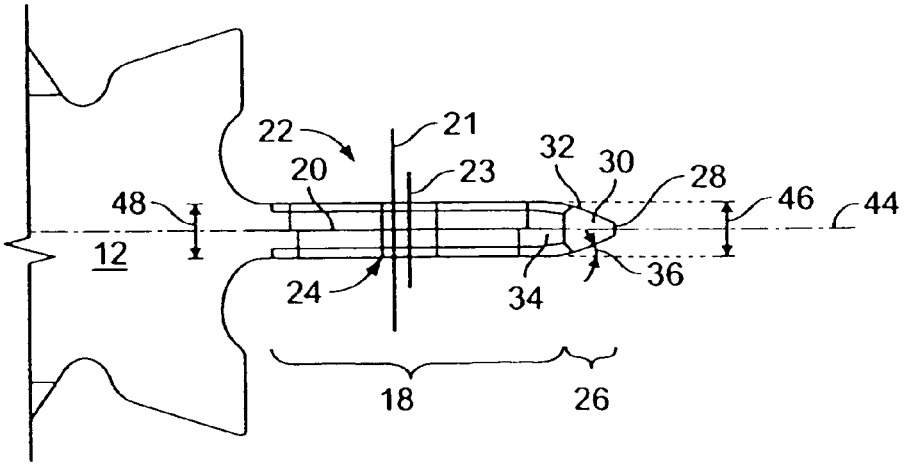
FIG. 3A is an enlarged perspective view of the portion of FIG. 3 within enclosure A.

In the embodiment shown in FIGS. 3 and 3A, the compliant portion 18 includes a taper 36. More specifically, a first width 46 of the compliant portion 18 (i.e., the combined width of the legs 22, 24 as measured along the end of the compliant portion 18 adjacent to the end portion 26) is less than a second width 48 of the compliant portion 18 as measured along the end of the compliant portion 18 adjacent to the base 12. For clarity, the width is measured along a line extending between the side edges of the legs that is substantially perpendicular to the central plane 44 extending from the base 12 to the end 28. In one embodiment, the total amount of the taper 36 is between about zero and about 0.6 degrees, and in another embodiment, the total amount of the taper 36 is between about 0.1 and about 0.3 degrees. For example, for a compliant portion 18 that is about 0.05 inch (1.27 millimeter) in length, a taper of about 0.6 degrees applied to only one side of the compliant portion equates to an increase in width of about 0.001 inch (0.025 millimeter). Similarly, proportionally reduced tapers can be calculated for compliant portions having other dimensions.

In one embodiment, the taper 36 is formed on each of the opposite sides of the compliant portion 18 substantially perpendicular to the upper and lower surfaces 34, 35, each taper being about zero to about 0.6 degrees. The thickness of the legs 22, 24 (i.e., the distance between upper and lower surfaces 34, 35) may remain substantially constant, or a secondary taper may be formed in the legs 22, 24. More specifically, the distance between the upper and lower surfaces 34, 35 may be varied between the end 28 and the base 12 to form a second taper that decreases in a direction from the base 12 toward the end 28, to supplement the effect of the taper 36.

In the embodiment of FIGS. 3 and 3A, the slit 20 has a center 21, or centerline, while legs 22, 24, or leg segments, may have vertically aligned centers of curvature 23 or deformation, in instances where the deformation of the legs is considered to be nonlinear. In some embodiments of the present invention, the slit centerline 21 and at least one, and preferably each, center of curvature 23 of the legs 22, 24 are noncoincident. Stated another way, the midpoint of one or both of the deformed legs 22, 24 is offset from the midpoint or center 21 of the slit 20, where the slit extends a first distance from an axis intersecting the midpoint of the leg(s) toward the tip end 28, and a second distance from the axis toward the base 12, and where the first distance is less than the second distance. By virtue of at least this offset, or the combination of this offset, the taper 36 in compliant portion 18, the tapers 30, 32 in end portion 26, and/or the secondary taper, the insertion force of the insertion portion 14 into a panel member aperture may be reduced and may be substantially uniform over substantially the entire length of insertion into the panel member aperture, or at least over a certain portion of terminal travel within the aperture.

Figure 7:
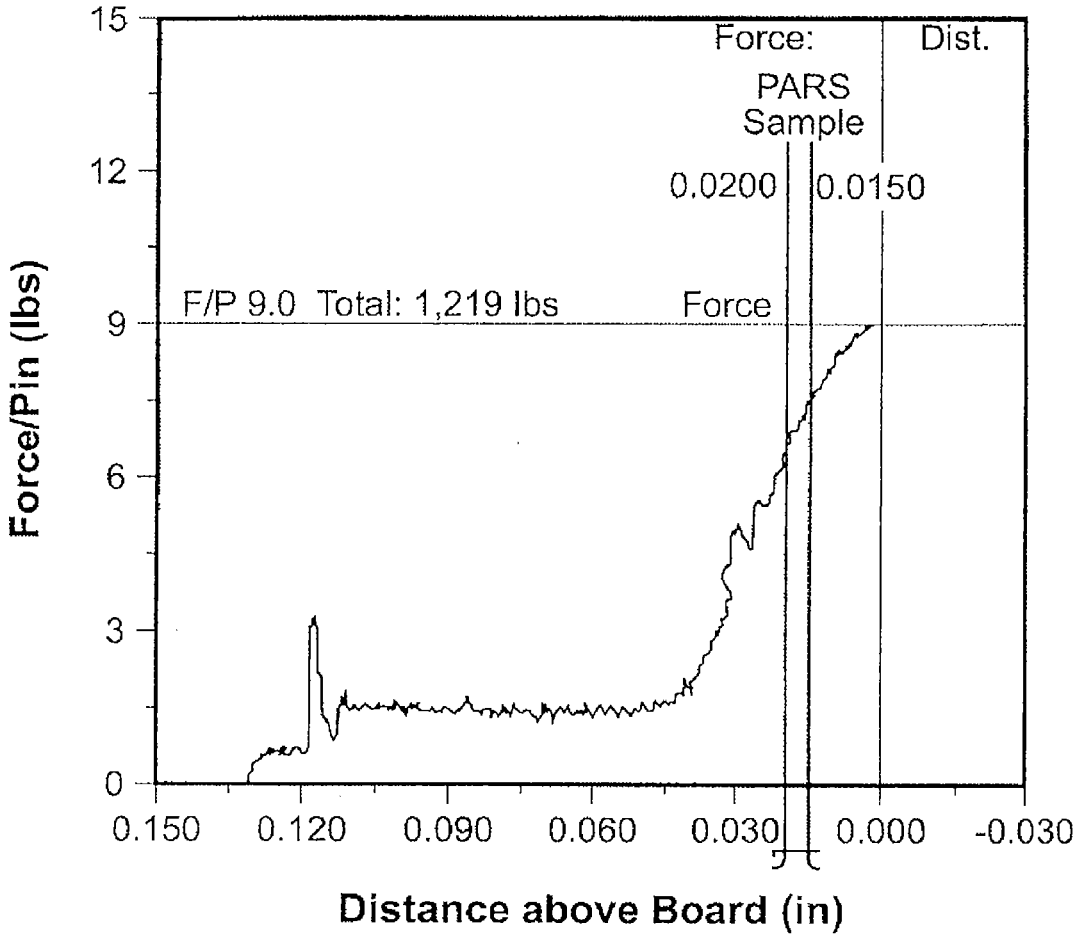
FIG. 7 is a graph illustrating a substantially constant insertion force profile as obtained in one embodiment of the present invention.

In some embodiments of the present invention, the slit 20 and leg members 22, 24 are configured to cooperate to achieve a desired insertion force profile, such as a profile that is substantially uniform along at least about 40%, at least about 50%, or at least about 60% of the distance traversed by an electrical terminal during insertion into a panel member aperture. One such embodiment is shown in FIG. 7. In certain embodiments, the compliant portion of an electrical terminal has a size and shape sufficient to achieve an insertion force profile that varies less than about 20%, less than about 15%, or less than about 10%, for example, over at least a certain portion of terminal travel, where the percent variance is the variation in force over that portion of terminal travel as a percentage of the total force required to fully seat the terminal within the panel member aperture. In other embodiments, the insertion force profile varies less than about 5% or less than about 1%. In still other embodiments, the insertion force varies less than about 1 pound per pin, less than about 0.5 pounds per pin, or less than about 0.25 pounds per pin along the measured distance of travel.

In some embodiments, the force required to fully insert the electrical terminal into a panel member aperture (insertion force) is less than about 6 pounds per terminal, less than about 5 pounds per terminal, or less than about 4 pounds per terminal, for example. In some embodiments, the insertion force is between about 5 pounds per terminal and about 10 pounds per terminal or between about 3 pounds per terminal and about 6 pounds per terminal. In certain embodiments of the present invention, the terminal is configured to withstand an insertion force of at least about 4 pounds.

Surprisingly, various embodiments of the present invention in which the mounting end of the electrical terminal has a surface area of no more than about 1.3 square millimeters or no more than about 2.5 square millimeters, or a width of no more than about 0.24 millimeters or no more than about 0.36 millimeters require a force of at least about 1 pound, at least about 2.5 pounds, or at least about 3 pounds to remove the electrical terminal from a panel member aperture (retention force). The retention force of an electrical terminal having a compliant section is a measure of the retention of the compliant section within an aperture or plated through-hole. Thus, some embodiments have a retention force per unit area of about 0.77 pounds per square millimeter to about 1.1 pounds per square millimeter. In other embodiments, the terminal is configured to substantially maintain its position within a panel member aperture up to a withdrawal force of about 1 to 2 pounds, about 4 pounds, or about 5 pounds, for example. Such retention forces insure that there is adequate contact between the mounting end of the terminal and the panel member aperture so that acceptable electrical characteristics are obtained.

In addition to contributing to reduced insertion forces and substantially more uniform insertion force profiles, the taper 36 in some embodiments of the electrical terminal 10 of the present invention provides improved electrical performance. For example, in some embodiments, an increased amount of surface area of the legs 22, 24 in physical contact with a panel member aperture, also referred to as a sleeve or barrel, improves electrical performance. The sleeve may be a plated through-hole. The references herein to a diameter of an aperture refer to the inner diameter of such a plated through-hole. The increased surface area may provide improved electrical performance despite a decrease in radial interference between the legs 22, 24 and the panel member aperture. Moreover, by virtue of the legs 22, 24 of the insertion portion 14 being offset from the center 21 of slit 20, the legs 22, 24 may be disposed a lesser distance from the end 28 of the end portion 26. This shorter distance between the regions of contact of the legs 22, 24 and the panel member aperture and end 28 improves electrical performance by reducing the time frame required to reflect electrical energy pulses that travel from the regions of contact of the legs 22, 24 toward the end 28 before propagating back through the legs 22, 24 toward the beam portion 16 of electrical terminal 10 to the path of electrical connection.

In some embodiments of the present invention, the end portion 26 of the electrical terminal 10 is disposed between the end 28 and the compliant portion 18, and a first taper 32 is formed adjacent to the end 28 along opposite sides of end portion 26. In addition, a second taper 30 also may be formed adjacent to the end 28 along the upper and lower surfaces 34, 35 of the end portion 26. That is, the second taper 30 may be oriented about 90 degrees from the first taper 32. In one embodiment, the tapers 30, 32 are of equal magnitude. Such a double tapered, substantially pointed end portion 26 improves alignment with apertures in a panel member and reduces sliding resistance between the end portion 26 and the panel member aperture.

In some embodiments of the present invention, the end portion 26, which also may be referred to as a tactile feedback tip or alignment tip, of an electrical terminal 10 includes a resting ledge 31, as shown in FIG. 1A, and a tapered lateral engagement section 33 that is smaller in the radial dimension than an aperture of a pattern of apertures in a substrate 64, such as a panel member or circuit board. The apertures may have any suitable shape and size and may be arranged in any pattern suitable for obtaining a desired pin density. For example, one or more of the apertures may have a diameter of less than about 0.02 inch (0.51 millimeter), less than about 0.016 inch (0.41 millimeter), or less than about 0.012 inch (0.3 millimeter) so as to achieve a pin density of at least about 120 pins per square inch, at least about 195 pins per square inch, at least about 200 pins per square inch, at least about 225 pins per square inch, or at least about 255 pins per square inch. The apertures may comprise a plating, if desired, and the combined surface area of the first leg member 22 and the second leg member 24 of the compliant portion 18 in contact with the plating may be at least about 0.09 square millimeters.

In the embodiment of FIG. 1A, the resting ledge 31 is configured to cooperate with the substrate to maintain the compliant portion 18 of the electrical terminal 10, which when uncompressed may be larger in the radial dimension than the aperture, above the substrate under the weight of a connector housing capable of holding a plurality of electrical terminals 10 for registration with the pattern of apertures. The resting ledge 31 of the alignment tip 26 also allows for lateral movement of the connector sufficient to allow the lateral engagement section 33 to cooperate with or engage the substrate and provide tactile feedback to a user to facilitate alignment of the tip with an aperture in a panel member.

In some embodiments of the present invention, a tactile feedback tip of an electrical connector includes a plurality of tapered segments, as shown in FIGS. 1A, 2A, and 3A. In one embodiment, the tactile feedback tip 26 includes a first portion 30 having a first taper, the first portion 30 being positioned adjacent to an upper surface 34 (along the width of the tip), and a second portion 32 having a second taper, the second portion being positioned between the upper surface 34 and the lower surface 35 (along the thickness of the tip). The first taper and the second taper may have the same magnitude or different magnitudes. In some embodiments, the tip 26 contains a tip end 28, a longitudinal axis that passes through the tip end 28, a first tapered segment 30 positioned adjacent the tip end 28, a second tapered segment 32 positioned adjacent the tip end 28 and adjacent the first tapered segment 30, and a third segment 34, or upper surface, positioned adjacent the first tapered segment 30, adjacent the second tapered segment 32, and adjacent a slit opening 20. The tip may be configured to permit the use of tactile feedback to align the tip with an aperture in a panel member. In some embodiments, the first tapered segment (along the width of the tip) has a taper angle of about 20 degrees to about 30 degrees, or about 0 degrees to about 20 degrees; and the second tapered segment (along the thickness of the tip) has a taper angle of about 12 degrees to about 18 degrees, or about 20 degrees to about 25 degrees.

Figure 6:
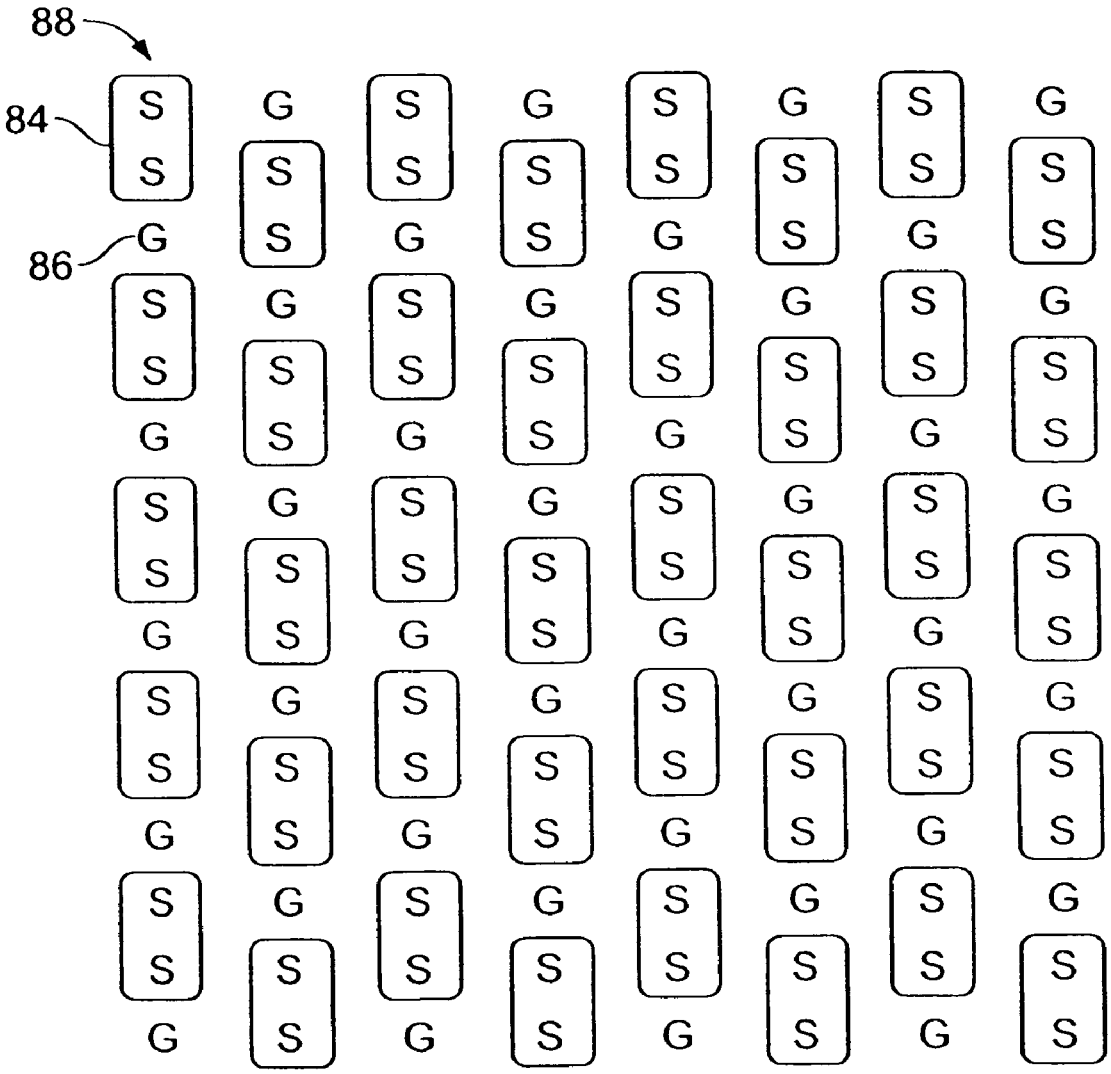
FIG. 6 is a pin configuration for one embodiment of a connector of the present invention.
Figure 6A:
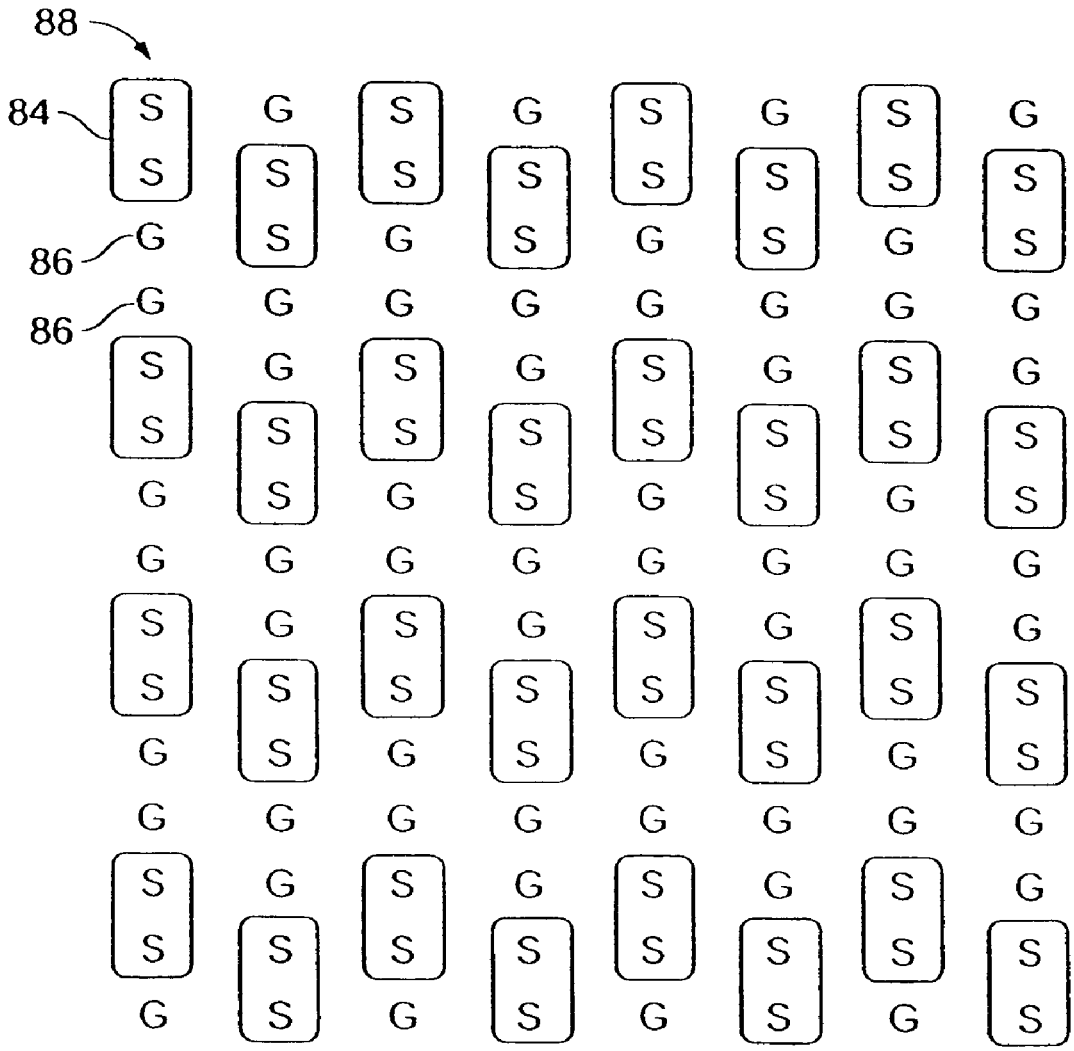
FIG. 6A is a pin configuration for another embodiment of a connector of the present invention.

Certain embodiments of the present invention are electrical connectors that have various pin densities, configurations, arrangements, and assignments, while maintaining acceptable mechanical and electrical performance criteria. For example, the electrical terminals 10, or pins, of the connector may be arranged in linear arrays (i.e., arrays that are generally linear) and may be assigned to ground, single-ended signals, differential signals, or power, while maintaining acceptable levels of cross-talk, insertion loss, and impedance. In some embodiments, each array includes a plurality of differential signal pairs separated by one or more ground terminals. The differential signal pairs in adjacent arrays may be offset, for example by a row pitch or less (as shown in FIGS. 6 and 6A), or by two row pitches, to minimize the cross talk between the differential signal pairs within the connector. Other cross-talk minimizing configurations may also be used, such as the configurations disclosed in U.S. Pat. No. 7,207,807, which is incorporated herein by reference in its entirety. The adjacent linear arrays may have any suitable column spacing distance, such as about 1.5 millimeters, about 1.6 millimeters, about 1.8 millimeters, or less than about 2 millimeters. In some configurations, the distance between the centerlines of two electrical terminals that make up a differential signal pair is less than the distance between any one of those centerlines and the centerline of a ground terminal.

Figure 5B:
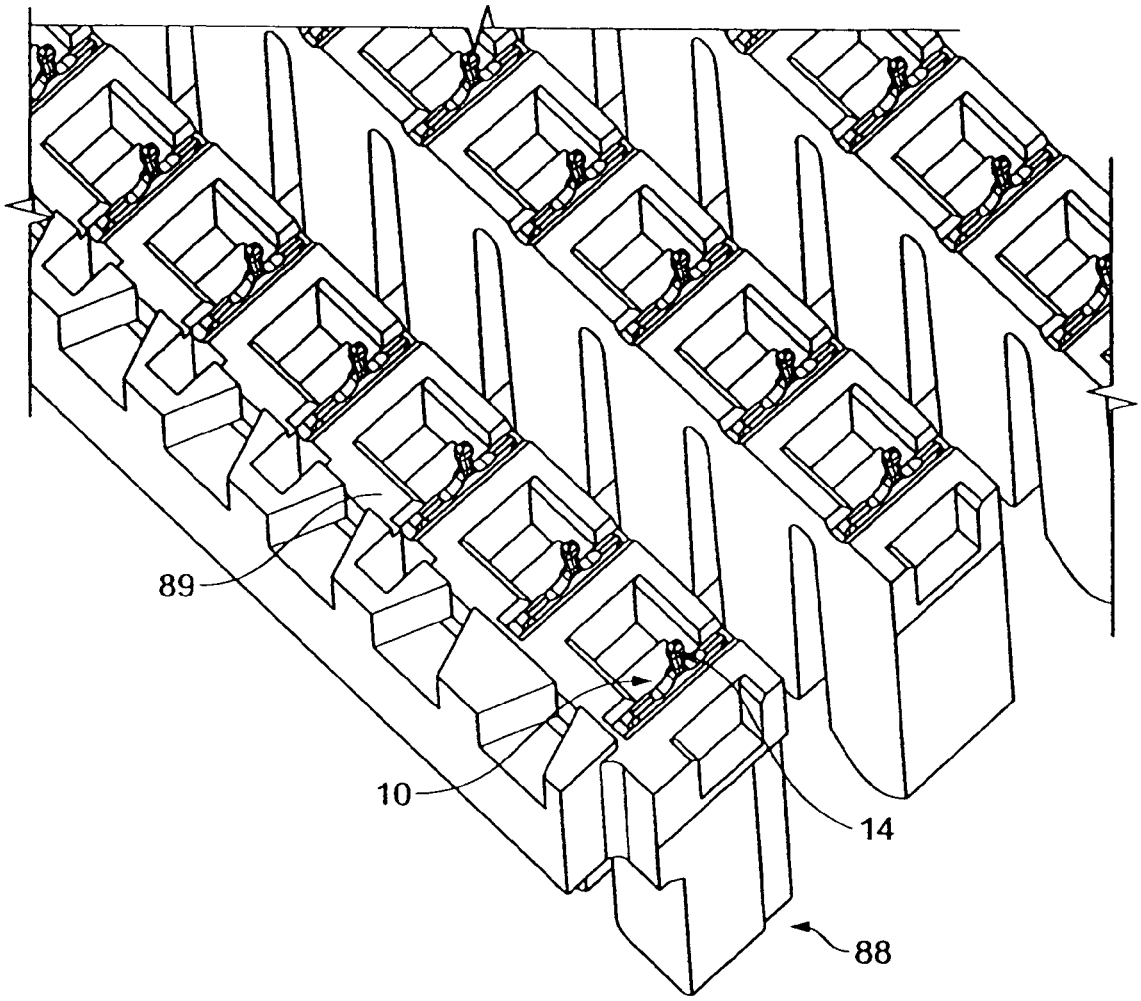
FIG. 5B is a partial perspective view of one embodiment of a connector of the present invention having terminals positioned broadside-to-broadside within a housing.
Figure 5C:
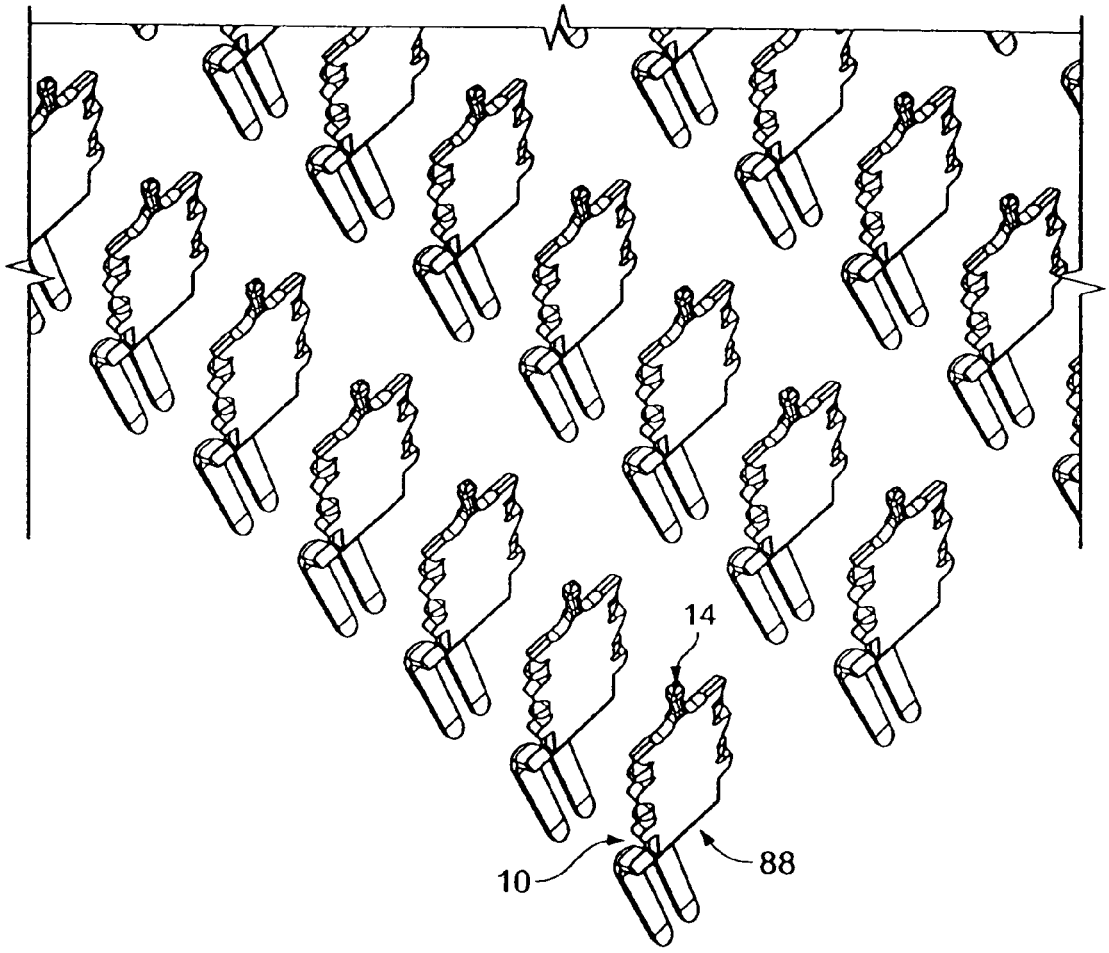
FIG. 5C is a partial perspective view similar to FIG. 5B with the housing removed.

In the embodiment shown in FIGS. 5 and 5A, the electrical connector 70 includes a housing 76, a first plurality of electrical terminals in a first lead frame 72, and a second plurality of electrical terminals in a second lead frame 73, where the second lead frame 73 is positioned adjacent to the first lead frame 72, and where a first electrical terminal 10 of the first plurality of electrical terminals has a mounting end having a first maximum width, a second electrical terminal 74 positioned adjacent to the first electrical terminal 10 in the first lead frame 72 has a mounting end having a second maximum width, a third electrical terminal of the second plurality of electrical terminals has a mounting end having approximately the first maximum width, and a fourth electrical terminal positioned adjacent to the third electrical terminal in the second lead frame 73 has a mounting end having the second maximum width, wherein the first maximum width is not equal to the second maximum width. In the embodiment of FIGS. 5 and 5A, the first maximum width is less than the second maximum width, and the mounting ends of the terminals are positioned edge-to-edge. In some embodiments, the first and third terminals may comprise signal contacts (single-ended or differential) and the second and fourth terminals may comprise ground contacts. In certain embodiments, the terminals are stitched into openings within a housing, rather than being positioned within lead frames. The signal contacts may be offset from each other, as shown in FIGS. 6 and 6A, for example, so that cross-talk within the connector is minimized In other embodiments, the mounting ends 14 of the terminals 10 are positioned broadside-to-broadside within a linear array 88, as shown in FIGS. 5B and 5C. Such electrical terminals 10 may be positioned within lead frames or may be stitched into openings within a housing 89.

In some embodiments of the present invention, such as the embodiment shown in FIG. 1, the beam portion 16, or mating end, of the electrical terminal 10 is the portion of the terminal that mates with another terminal, and the insertion portion 14, or mounting end, of the electrical terminal 10 is the portion of the terminal that is configured for mounting in a panel member or similar structure. Each of the mating end 16 and the mounting end 14 of an electrical terminal 10 may have a cross-section that defines an edge and a broadside, where the broadside is longer than the edge. The edge of one electrical terminal of a connector of the present invention may be positioned adjacent to the edge of an adjacent electrical terminal within an array of electrical terminals, as shown in FIGS. 5 and 5A, or the broadside of one terminal may be positioned adjacent the broadside of an adjacent terminal within an array, as shown in FIGS. 5B and 5C. Such edge-to-edge positioning and broadside-to-broadside positioning refers only to the geometric arrangement of the terminals and does not necessarily refer to any electrical coupling of the terminals. In some embodiments, the edge of the mating end of one differential signal is positioned adjacent to the edge of the mating end of another differential signal in the same linear array. Similarly, in other embodiments, the edge of the mounting end of one differential signal is positioned adjacent to the edge of the mounting end of another differential signal in the same linear array. In still other embodiments, the mounting ends of the electrical terminals are positioned broadside-to-broadside, or the mounting ends of some terminals are positioned broadside-to-broadside, whereas the mounting ends of other terminals are positioned edge-to-edge.

In some embodiments of the present invention, an electrical connector contains electrical terminals having different shapes and sizes, and/or panel member apertures having different shapes or sizes. One embodiment of an electrical terminal of the present invention 10 is shown in FIG. 4, as compared with three other electrical terminals 78, 80, 82, any of which may be used in conjunction with the electrical terminal 10 in a single connector. As shown in FIG. 4, in certain embodiments, the electrical terminal of the present invention 10 is substantially smaller than other electrical terminals that may be used in the same connector.

In certain embodiments, the electrical terminals of a first differential signal pair are configured to be inserted into a panel member aperture having a first width, and a first ground terminal is configured to be inserted into a panel member aperture having a second width, where the first width is less than the second width. The apertures may be of any suitable shape and size. For example, the apertures may be of a generally circular shape and may have a first width that is a diameter of less than about 0.016 inch (0.41 millimeter) or less than about 0.014 inch (0.36 millimeter), and a second width that is a diameter of greater than about 0.03 inch (0.76 millimeter) or greater than about 0016 inch (0.41 millimeter); or the first width may be a diameter of less than about 80%, 70%, 60%, 50%, or 40% of the second diameter. In certain embodiments of the present invention, the insertion of an electrical terminal into a panel member aperture results in radial deformation of the aperture, where the deformation of the aperture may facilitate retention of the terminal within the aperture, but does not exceed a predetermined amount. In some embodiments, the electrical terminals of a differential signal pair each have a width (or volume) that is less than the width (or volume) of a ground terminal in the same connector. For example, the volume of each of the electrical terminals of a differential signal pair may be less than about 80%, 70%, 60%, 50%, or 40% of the volume of the ground terminal.

One embodiment of a connector of the present invention includes electrical terminals 10 of a differential signal pair, where each terminal has a compliant portion with a first length, and a ground terminal 74 with a compliant portion having a second length that is greater than the first length. The connector may include a plurality of adjacent linear arrays in which each terminal of a differential pair has a compliant portion with the first length, and each ground terminal has a compliant portion with the second length. In some embodiments, the differential signal pairs 84 within a linear array 88 are separated by one or more ground terminals 86 in the linear array 88, as shown in FIGS. 6 and 6A.

In some embodiments of the present invention, the insertion portion 14 of the electrical terminal 10 may be configured for insertion into a panel member aperture of less than about 0.016 inch (0.41 millimeter), which aperture may be of any suitable shape, such as a generally circular shape. For example, a panel member may have a thickness of about 0.02 inch (0.51 millimeter) and an aperture diameter of about 0.009 inch (0.23 millimeter), and the electrical terminal 10 may have an insertion portion 14 that has a maximum width of less than about 0.016 inch (0.41 millimeter) in a flexed position. In other embodiments of the present invention, the compliant section 18 has a width sized to cooperate with an aperture having a diameter of less than about 0.012 inch (0.3 millimeter).

In various embodiments, the present invention has desirable electrical characteristics at the mating end of the terminal, the mounting end of the terminal, or both ends of the terminal. For example, in certain embodiments, a connector containing a plurality of electrical terminals arranged in linear arrays in a housing has a substantially constant impedance profile (with a variance of less than about 10 percent, for example) and a worst case multi-aggressor asynchronous differential cross-talk of less than about six percent at an initial rise time of about 40 picoseconds. In other embodiments, the connector has less than about three percent or less than about two percent cross talk at an initial rise time of about 40 picoseconds. In still other embodiments, the connector has less than about six percent, three percent, or two percent worst case multi-aggressor asynchronous differential cross talk at an initial rise time of about 40 picoseconds.

In certain embodiments of the present invention, an electrical connector having a pin density of at least about 195 pins per square inch or at least about 200 pins per square inch is provided. In other embodiments, the connector has a pin density of at least about 225 pins per square inch or at least about 255 pins per square inch. In still other embodiments, the connector has a signal pin density of at least about 70 signal pins per square inch or at least about 80 signal pins per square inch. The electrical terminals of a connector of the present invention may contain the electrical terminals described herein, electrical terminals in the prior art, or a combination of both, to obtain a connector with a desired pin density and acceptable mechanical and electrical properties.

In some embodiments, the connector has a pin density of at least about 200 pins per square inch or at least about 225 pins per square inch, and a differential impedance of between about 85 ohms and about 115 ohms. Some embodiments have an insertion loss of less than about 2 dB at 5 GHz. Other embodiments have an insertion loss of less than about 3 dB at 10 GHz.

In certain embodiments of the present invention, desirable electrical and mechanical characteristics are achieved by an electrical terminal 10 having a mounting end 14 that is substantially smaller than its mating end 16. More specifically, in some embodiments, the mounting end defines a length and/or width that is less than about 50% of the length and/or width of the mating end. Alternatively, the mounting end 14 may define a length and/or width that is less than about 60%, 40%, or 30%, for example, of the width of the mating end 16. In other embodiments, the mounting end 14 defines a cross sectional area that is less than about 60% of the cross sectional area of the mating end 16. Alternatively, the mounting end 14 may define a cross sectional area that is less than about 70%, 50%, 40%, or 30%, for example, of the cross sectional area of the mating end 16. FIG. 4 shows the relative dimensions of one embodiment of the electrical terminal of the present invention. This figure also shows a comparison of one embodiment of the electrical terminal 10 of the present invention with three existing electrical terminals 78, 80, 82. These existing electrical terminals 78, 80, 82 are examples of terminals that may be used in conjunction with, or that may be replaced by, the electrical terminal 10 of the present invention within a connector.

In one embodiment of an electrical connector of the present invention, the mounting ends of the electrical terminals of the connector extend from the connector housing a first distance, and the mating ends of the terminals extend from the housing a second distance. In another embodiment, such as the embodiment shown in FIG. 5A, the mounting end of a first electrical terminal 10 of the connector 70 extends from the housing or lead frame 72 a first distance d1, and the mounting end of a second terminal 74 in the same connector 70 extends from the housing or lead frame 72 a second distance d2. In either embodiment, the first distance may or may not be equal to the second distance. In certain embodiments, the first distance is less than about 80% of the second distance. In other embodiments, the first distance is less than about 50%, less than about 40%, or less than about 30%, of the second distance.

The mounting ends of two adjacent electrical terminals, such as the electrical terminals of an edge-to-edge positioned differential signal pair, may extend from the connector housing a first distance (which may be less than about 2 millimeters or less than about 1.6 millimeters, for example), and the mounting ends of at least one of the ground terminals of the connector may extend from the housing a second distance (which may be about 2 to 3 millimeters, for example), where the first distance is less than the second distance, and the worst case multi-aggressor asynchronous differential cross-talk of the connector is less than about five percent at an initial rise time of approximately 40 picoseconds. In some embodiments, the two adjacent electrical terminals each define a width (which may be about 0.2 to 0.25 millimeter, for example) that is smaller than the width of at least one of the ground terminals in the connector (which may be about 0.3 to 0.35 millimeter, for example). In other embodiments, the two adjacent electrical terminals each define a length that is smaller than the length of at least one of the ground terminals in the connector. In still other embodiments, the two adjacent electrical terminals each define a volume that is less than the volume of at least one of the ground terminals in the connector. For example, the volume of the mounting end of each of the two adjacent electrical terminals may be less than about 50% of the volume of the mounting end of the ground contact. In some embodiments, such as embodiments intended for use in daughtercard applications, the mounting end of the electrical terminal has a length of less than about 50% or less than about 40% of the thickness of a panel member. In other embodiments, such as embodiments intended for use in backplane applications, the mounting end of the electrical terminal has a length of less than about 25% or less than about 20% of the thickness of a panel member.

Figure 8:
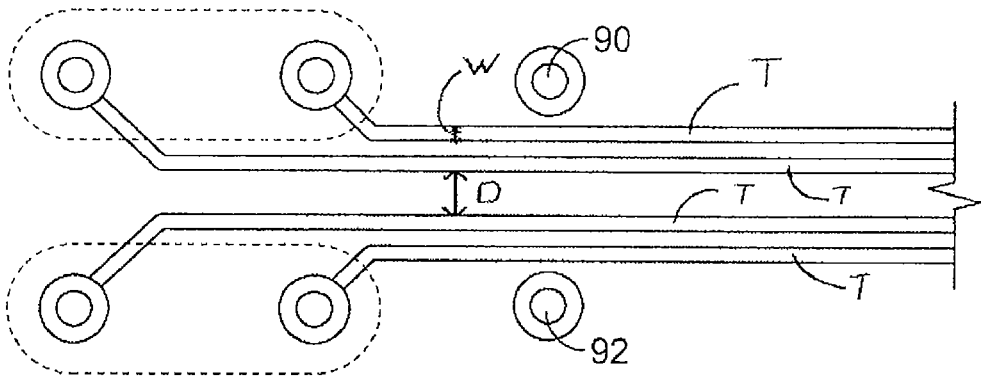
FIG. 8 is a top view of a panel member having four electrical traces routed between adjacent electrical terminals according to one embodiment of the present invention.

The electrical terminals of the present invention may be arranged in such a way as to route a plurality of electrical traces between two of the electrical terminals. In certain embodiments, at least two or at least three electrical traces may be routed between the terminals of a first linear array and a second linear array positioned adjacent to the first linear array, where each array includes terminals (such as signal contacts, for example) sized and shaped to fit within a panel member aperture having a diameter of about 0.016 inch (0.41 millimeter) or less. In other embodiments, such as the embodiment shown in FIG. 8, at least four electrical traces T may be routed between electrical terminals 90 and 92, where each of the traces T has a width W of about 0.004 inches (0.1 millimeter) and where the traces T are separated from each other by a distance D of at least about 0.005 inches (0.13 millimeter). In certain embodiments, each of four electrical traces comprises a differential signal trace having a width, where each trace is separated from an adjacent trace by a distance of at least about two times the width of the trace. In some embodiments, the distance between centerlines of adjacent linear arrays is less than about 1.4 millimeters, for example.

One embodiment of the present invention provides a method for routing a plurality of electrical traces between adjacent electrical terminals of an electrical connector. In some embodiments, the method includes: providing a panel member with a first aperture and a second aperture positioned adjacent to the first aperture, where each aperture has a width or diameter of less than about 0.012 inch (0.3 millimeter), for example; inserting a first electrical terminal into the first aperture and a second electrical terminal into the second aperture; and routing at least three electrical traces between the first electrical terminal and the second electrical terminal, while maintaining an acceptable level of cross-talk (such as near-end cross-talk or far-end cross-talk). The panel member also may include apertures having a width or diameter greater than the width or diameter of the first and second apertures. The electrical traces may have any suitable width, such as a width of at least about 0.004 inch (0.1 millimeter), and may be routed between any of the terminals (such as signal contacts and/or ground contacts) in the connector. For example, in the embodiment illustrated in FIG. 8, at least four electrical traces may be routed between a first terminal 90 or array of terminals and a second terminal 92 or array of terminals. In some embodiments, the first terminal is positioned within a first lead frame, and the second terminal is positioned within a second lead frame.

Figure 9:
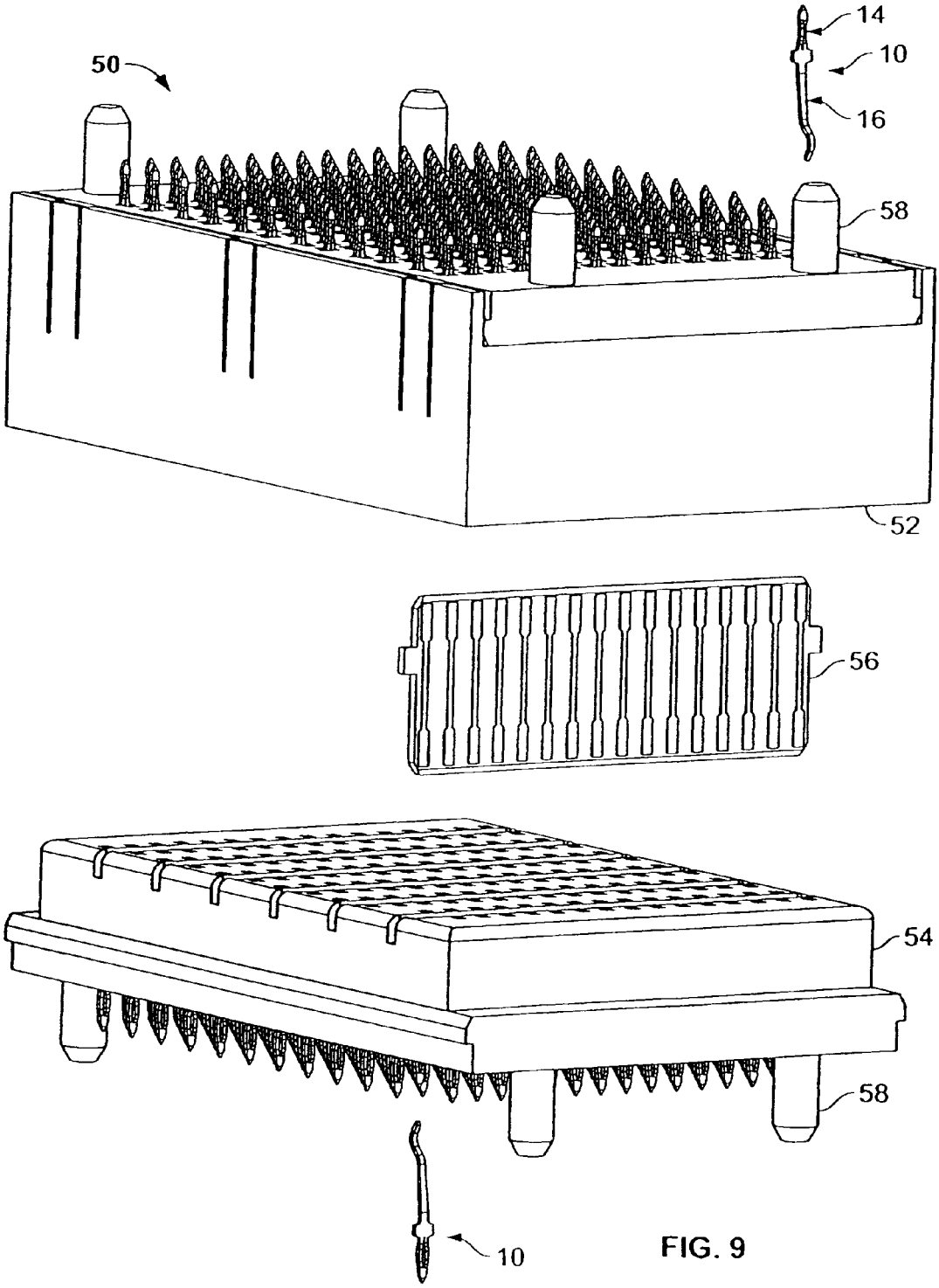
FIG. 9 is an exploded perspective view of one embodiment of a connector of the present invention.
Figure 10:
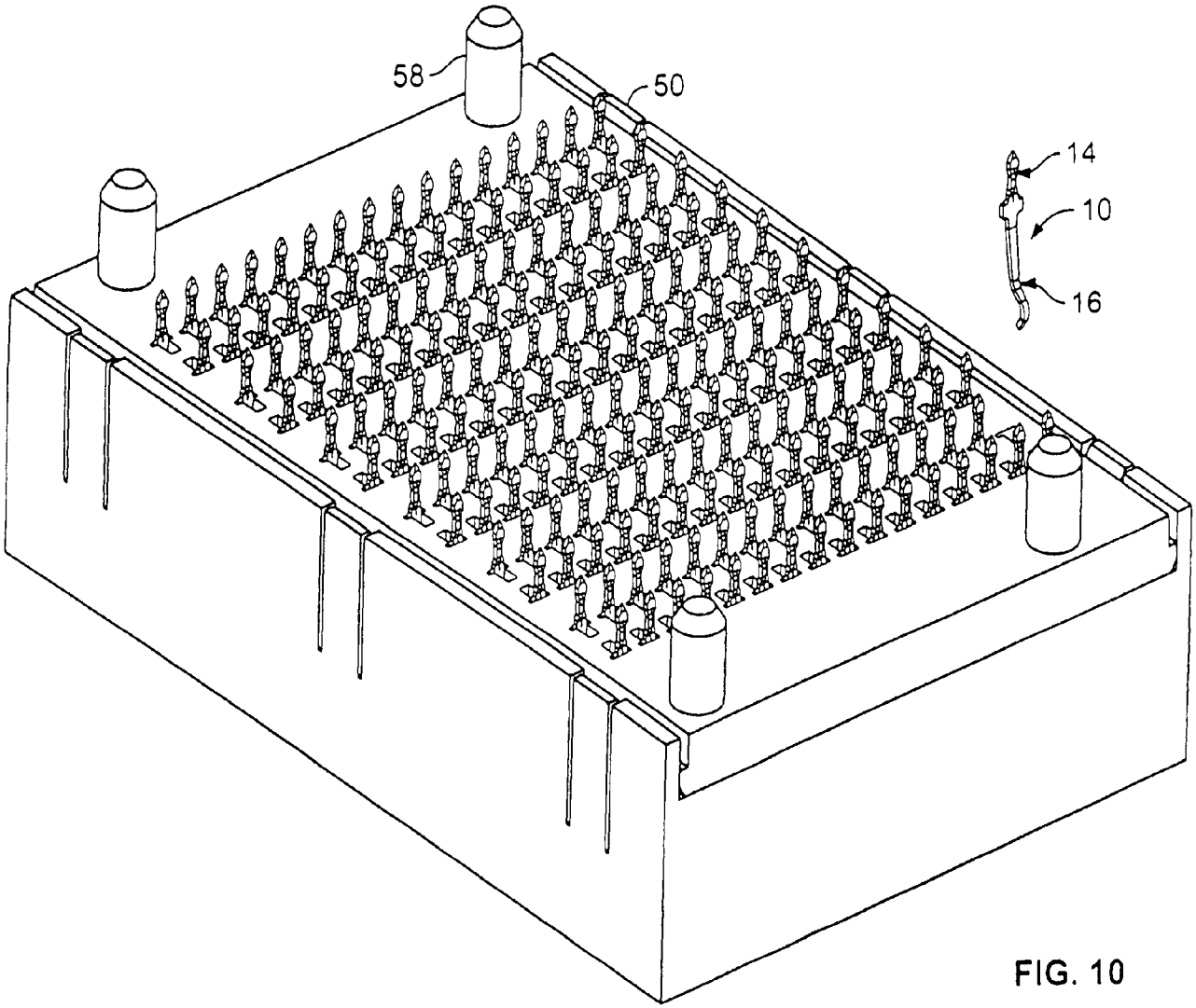
FIG. 10 is a perspective view of an assembled connector containing electrical terminals of one embodiment of the present invention.
Figure 11:
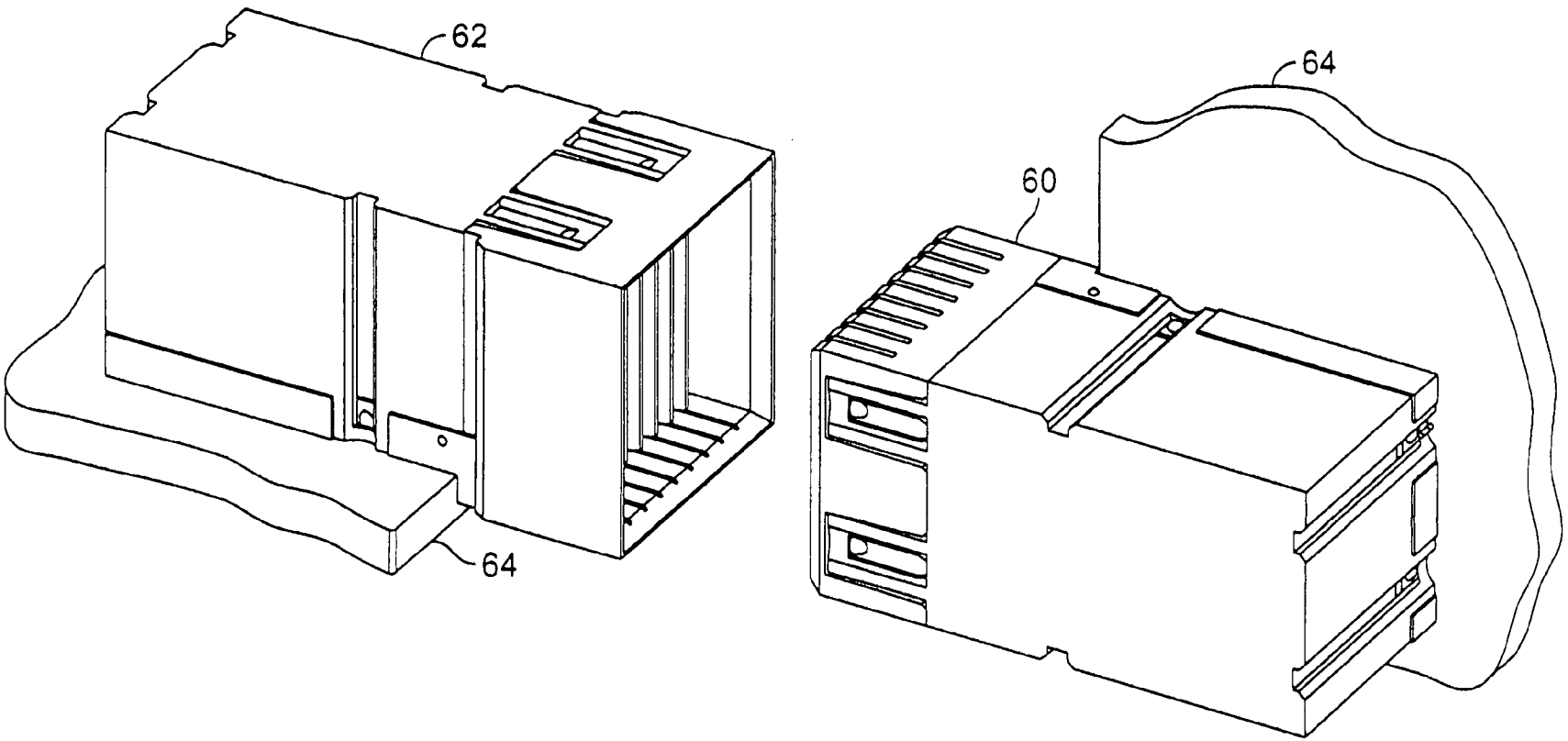
FIG. 11 is an enlarged partial perspective view of a pair of aligned mating connectors, where each connector is secured to a respective panel member.

FIGS. 9 to 11 show examples of connectors 50, 60, 62 that are usable with various embodiments of the electrical terminal 10 of the present invention to connect panel members 64. In the embodiment of FIG. 9, the connector 50 includes a connector portion 52 that is configured to receive a plurality of electrical terminals 10. The connector portion 52 also includes a plurality of alignment pins 58 (four) having corresponding apertures (not shown) to receive the alignment pins. Once the alignment pins 58 are received in the corresponding panel member apertures, alignment also may be achieved between the electrical terminals and their corresponding apertures in the panel member. As shown in FIG. 9, a connector portion 54 also is configured to receive a plurality of electrical terminals 10 and a plurality of alignment pins 58. The connector portions 52, 54 may be secured together to form the connector 50 and further include a plurality of interconnecting members 56 installed prior to assembly of the connector portions 52, 54 to provide electrical connectivity between the electrical terminals 10 in the connector portions. The connector 50 may be used to connect a plurality of panel members 64 of any type.

As shown in FIG. 11, some connectors 60, 62 are used to connect two or more panel members 64. In this embodiment, the connectors 60, 62 each include at least one side similar to connector 50 so that each of the connectors is connected to a corresponding panel member 64. As further shown in FIG. 11, the panel members 64 are assembled substantially perpendicularly to each other. However, the connectors 60, 62 may be configured so that the corresponding panel members 64 may be disposed end to end or at any angle from each other.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector comprising:

a housing;

a first linear array of electrical terminals each having a mating end and a mounting end, wherein the first linear array extends along a first direction and comprises a first signal terminal, a second signal terminal, and a first ground terminal;

a second linear array of electrical terminals each having a mating end and a mounting end, wherein the second linear array extends along the first direction, is positioned adjacent to the first linear array, and comprises a third signal terminal, a fourth signal terminal, and a second ground terminal;

wherein each of the first, second, third, and fourth signal terminals comprises a mounting end having a width that is no greater than about 60% of the width of the mating end; and wherein each of the first linear array and the second linear array comprises electrical terminals sized to fit within a panel member aperture having a diameter of about 0.3 millimeters or less.

2. The electrical connector of claim 1 wherein the electrical terminals sized to fit within a panel member aperture having a diameter of about 0.3 millimeters or less are signal contacts.

3. The electrical connector of claim 1 wherein the connector has a pin density of at least about 200 pins per square inch.

4. The electrical connector of claim 1 wherein the electrical terminals of the first linear array and the second linear array are arranged to permit routing of a plurality of electrical traces between the electrical terminals of the first linear array and the second linear array.

5. The electrical connector of claim 4 wherein the plurality of electrical traces comprises at least four electrical traces.

6. The electrical connector of claim 5 wherein each of the at least four electrical traces has a width, and wherein two electrical traces define a first pair and two electrical traces define a second pair, wherein the first pair is separated from the second pair by a distance of at least about two times the width of the trace.

7. A press-fit electrical connector comprising:

a first linear array of electrical terminals extending along a first direction, the first linear array comprising a first differential signal pair and a first ground terminal;

a second linear array of electrical terminals extending along the first direction and positioned adjacent to the first linear array, the second linear array comprising a second differential signal pair and a second ground terminal;

wherein the first differential signal pair is offset from the second differential signal pair;

wherein the electrical terminals are configured such that the electrical connector has a pin density of at least about 200 pins per square inch and a differential impedance of between about 85 ohms and about 115 ohms; and wherein the electrical terminals are configured for insertion into a panel member aperture having a diameter of less than about 0.3 millimeters.

8. The electrical connector of claim 7 wherein a distance between a centerline of the first linear array and a centerline of the second linear array is less than about 1.4 millimeters.

9. The electrical connector of claim 7 wherein the connector has an insertion loss of less than about 3 dB at 10 GHz.

10. The electrical connector of claim 7 wherein the electrical terminals are arranged to permit routing of at least four electrical traces between an electrical terminal of the first linear array and an electrical terminal of the second linear array.

11. The electrical connector of claim 7 wherein the electrical terminals of the first differential signal pair and the electrical terminals of the second differential signal pair each comprise a mounting end having a first width and a mating end having a second width, wherein the first width is substantially smaller than the second width.

12. The electrical connector of claim 11 wherein the first width is less than about half the second width.

13. A method for routing a plurality of electrical traces between adjacent electrical terminals of a press-fit electrical connector having a column spacing of about two millimeters or less, the method comprising:

providing a panel member comprising a first aperture having a diameter of less than about 0.3 millimeters and a second aperture having a diameter of less than about 0.3 millimeters, wherein the second aperture is positioned adjacent to the first aperture;

inserting into the first aperture a first electrical terminal;

inserting into the second aperture a second electrical terminal; and routing at least four electrical traces between the first electrical terminal and the second electrical terminal, while maintaining an acceptable level of worst case multi-aggressor asynchronous differential cross-talk.

14. The method of claim 13 wherein the panel member further comprises an aperture having a diameter greater than the diameter of the first aperture and greater than the diameter of the second aperture.

15. The method of claim 13 wherein each electrical trace has a width of at least about 0.004 inch.

16. The method of claim 13 wherein the first electrical terminal comprises a signal contact and the second electrical terminal comprises a signal contact.

17. The method of claim 13 wherein the first electrical terminal is positioned within a first lead frame and the second electrical terminal is positioned within a second lead frame.

* * * * *